US005870904A

United States Patent [19]

Shima et al.

[11] Patent Number: 5,870,904

[45] Date of Patent: Feb. 16, 1999

[54] KNITTING FABRIC TAKE-DOWN DEVICE OF FLAT KNITTING MACHINE

[75] Inventors: Masahiro Shima; Kenji Ikoma; Yoshiaki Hashimoto, all of Wakayama, Japan

[73] Assignee: Shima Seki MFG., Ltd., Wakayama-ken, Japan

[21] Appl. No.: 963,099

[22] Filed: Nov. 3, 1997

[30] Foreign Application Priority Data

| | | | |
|---|---|---|---|
| Nov. 6, 1996 | [JP] | Japan | 8-294221 |
| Sep. 5, 1997 | [JP] | Japan | 9-240601 |
| Sep. 5, 1997 | [JP] | Japan | 9-241414 |

[51] Int. Cl.[6] ..... D04B 15/88

[52] U.S. Cl. ..... 66/149 R

[58] Field of Search ..... 66/147, 148, 149 R, 66/150, 152

[56] References Cited

U.S. PATENT DOCUMENTS

| | | | |
|---|---|---|---|
| 3,375,683 | 4/1968 | Joseph | 66/149 R |
| 3,605,447 | 9/1971 | Blood et al. | 66/149 R |
| 3,618,343 | 11/1971 | Essig | 66/149 R |
| 4,646,544 | 3/1987 | Merkh | 66/149 R |
| 4,660,392 | 4/1987 | Stoppazzini | 66/149 R |
| 5,097,684 | 3/1992 | Shima . | |
| 5,369,967 | 12/1994 | Schmid et al. | 66/149 R |

FOREIGN PATENT DOCUMENTS

| | | |
|---|---|---|
| 57-55815 | 11/1982 | Japan . |
| 2-210046 | 8/1990 | Japan . |

*Primary Examiner*—Michael A. Neas
*Assistant Examiner*—Larry D. Worrell, Jr.
*Attorney, Agent, or Firm*—McAulay Nissen Goldberg Kiel & Hand, LLP

[57] ABSTRACT

Knitting fabric take-down devices, located in front and back of and facing each other across a knitting fabric passageway formed under a needle bed gap between at least a pair of front and back needle beds of a flat knitting machine, for taking down a knitting fabric. Each of the knitting fabric take-down device includes a front knitting fabric take-down mechanism for capturing only a front part of the knitting fabric in the knitting fabric passageway and taking it down; a back knitting fabric take-down mechanism for capturing only a back part of the knitting fabric and taking it down; and a take-down force adjusting mechanism for adjusting a take-down force of each of the knitting fabric take-down mechanism. The front and back knitting fabric take-down mechanism each comprises a plurality of take-down members which are arranged along a longitudinal direction of the needle beds and are each adapted to be sequentially or individually actuated to take down the knitting fabric in the knitting fabric take-down operation.

22 Claims, 24 Drawing Sheets

Fig.11-A
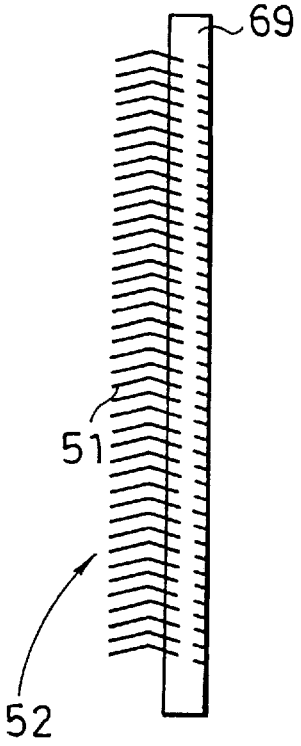
Fig.11-B
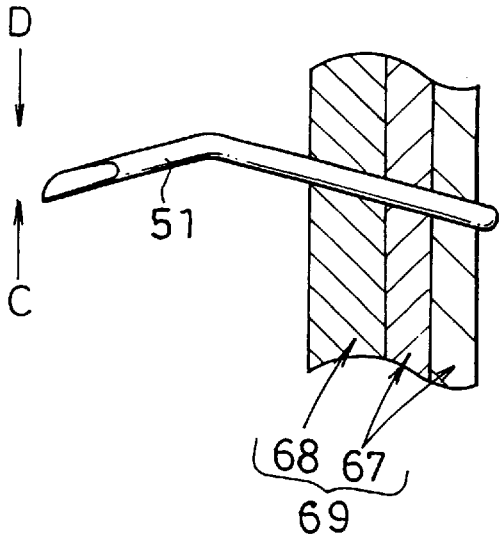
Fig.11-C
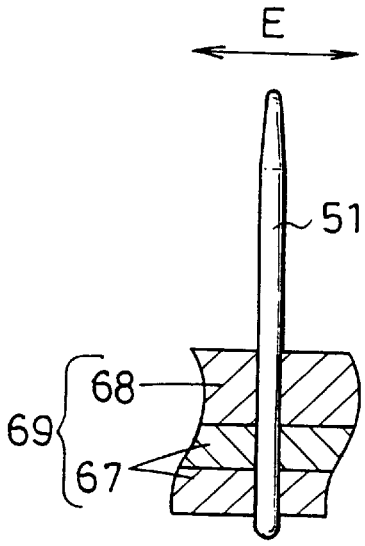

Fig.12
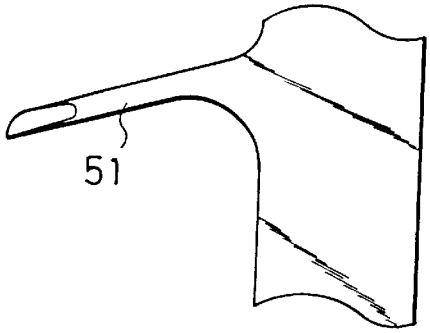
Fig.13
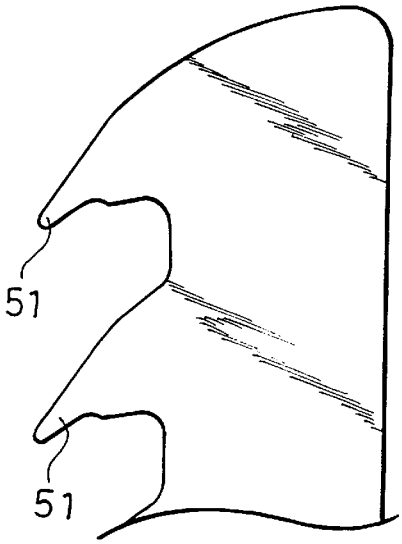
Fig.14-A
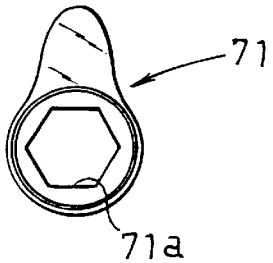
Fig.14-B
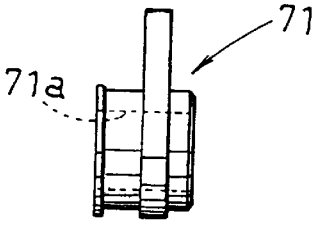

Fig.15-A
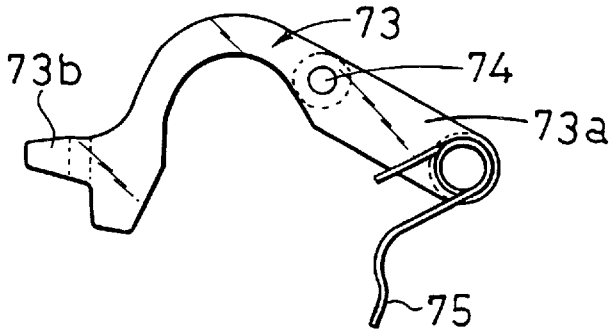
Fig.15-B
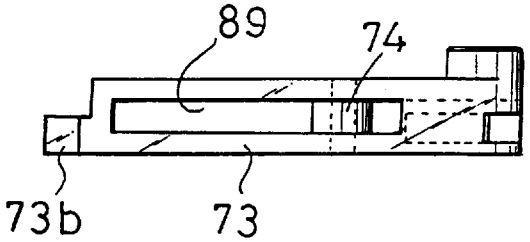
Fig.15-C
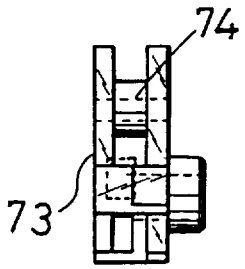

Fig.16-A
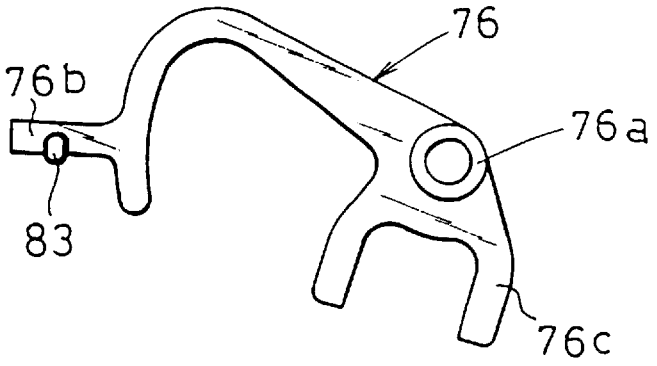
Fig.16-B
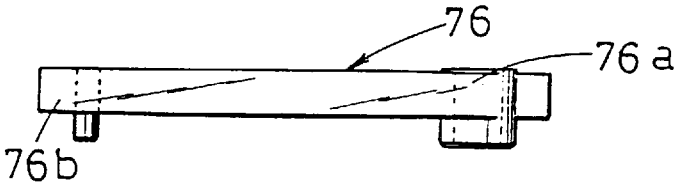
Fig.16-C
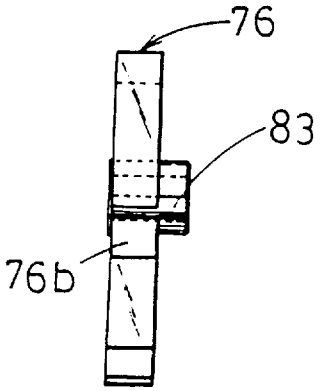

Fig.17-A
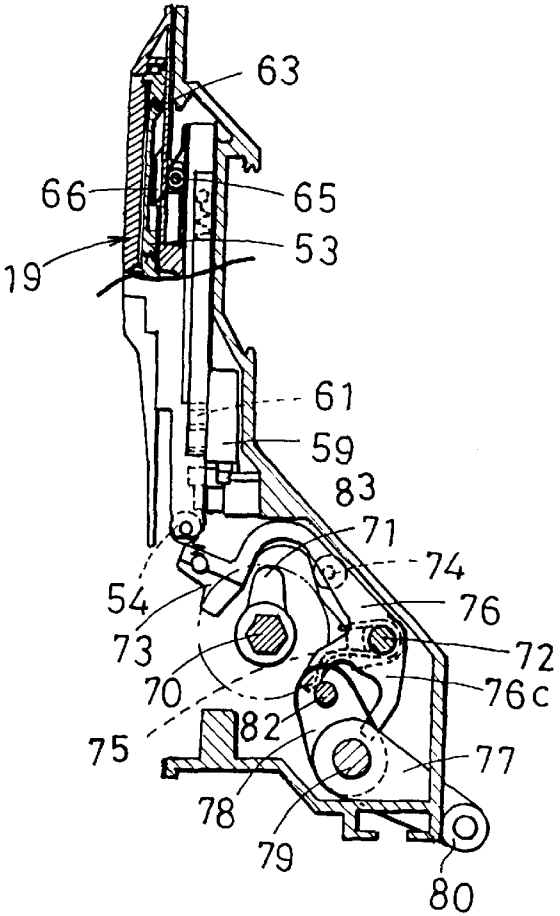
Fig.17-B
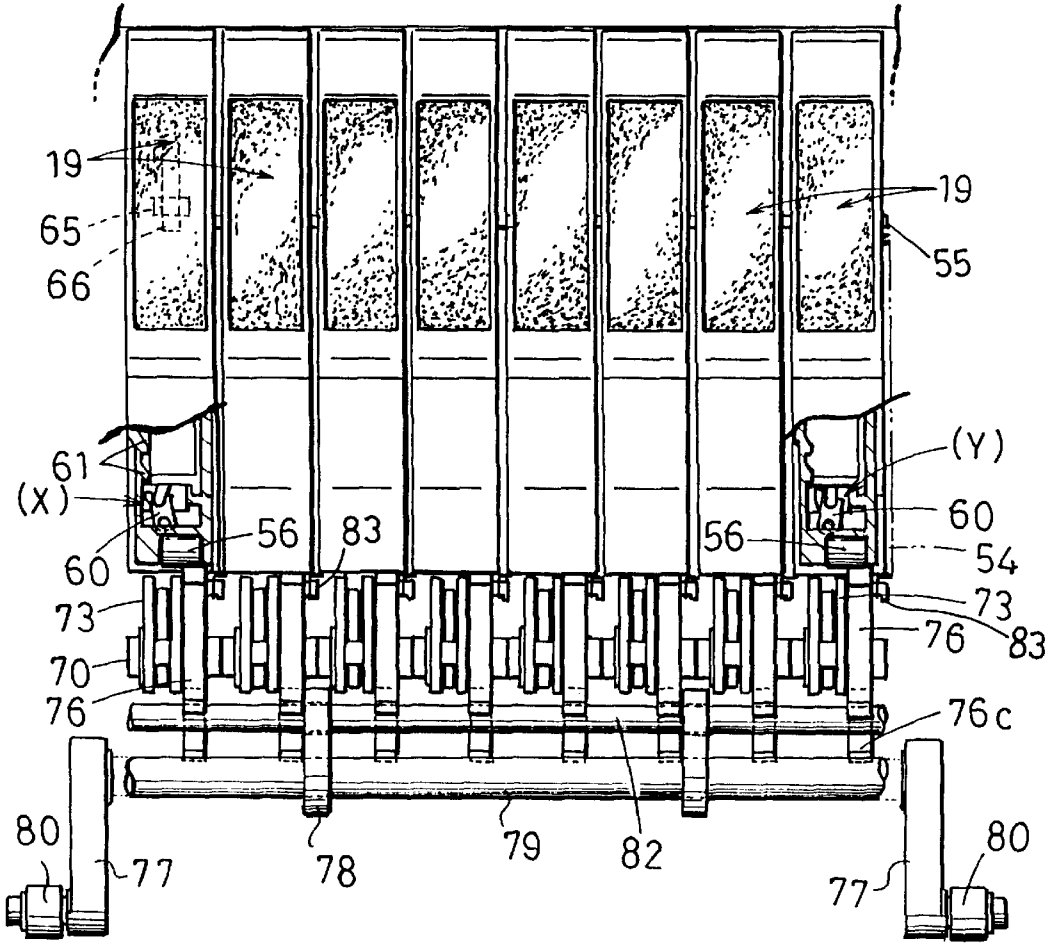

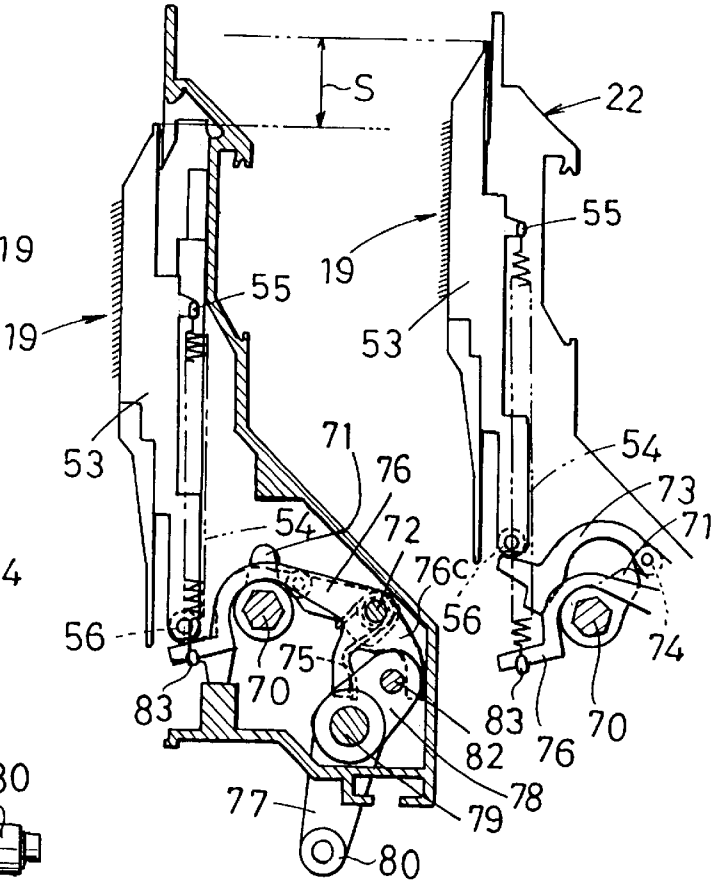
Fig.18-A
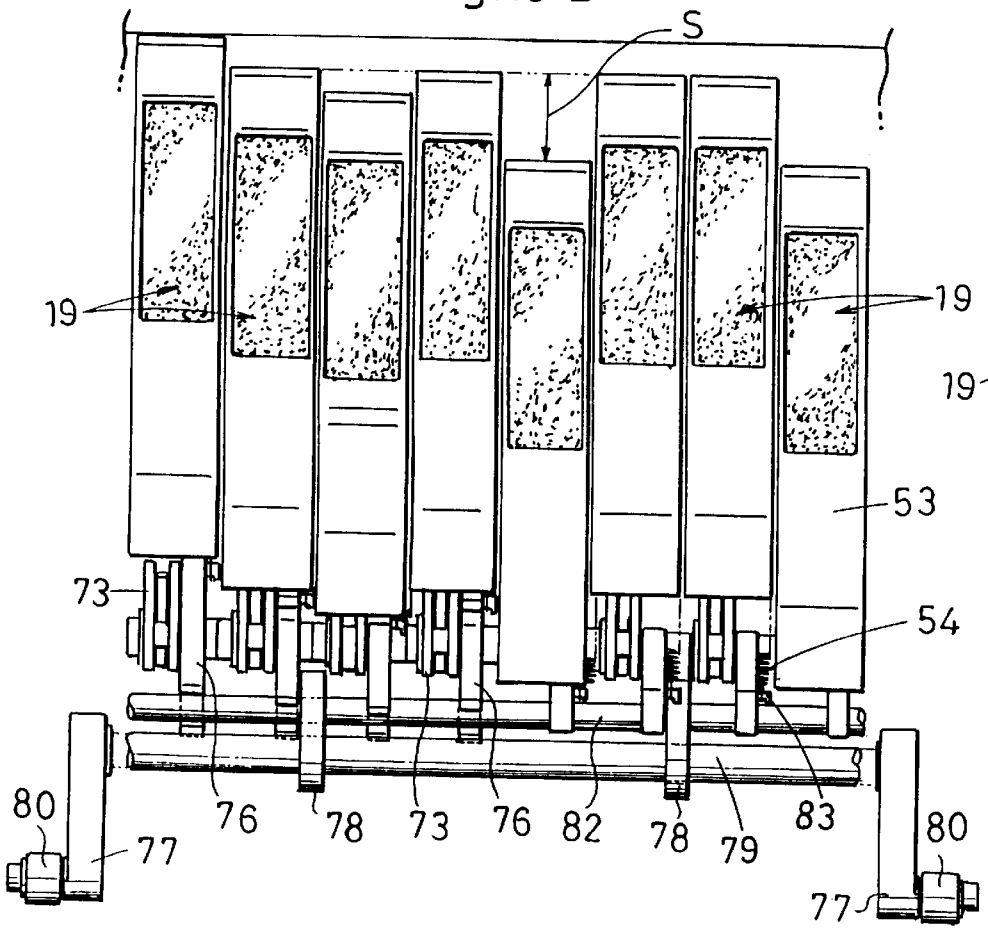
Fig.18-B

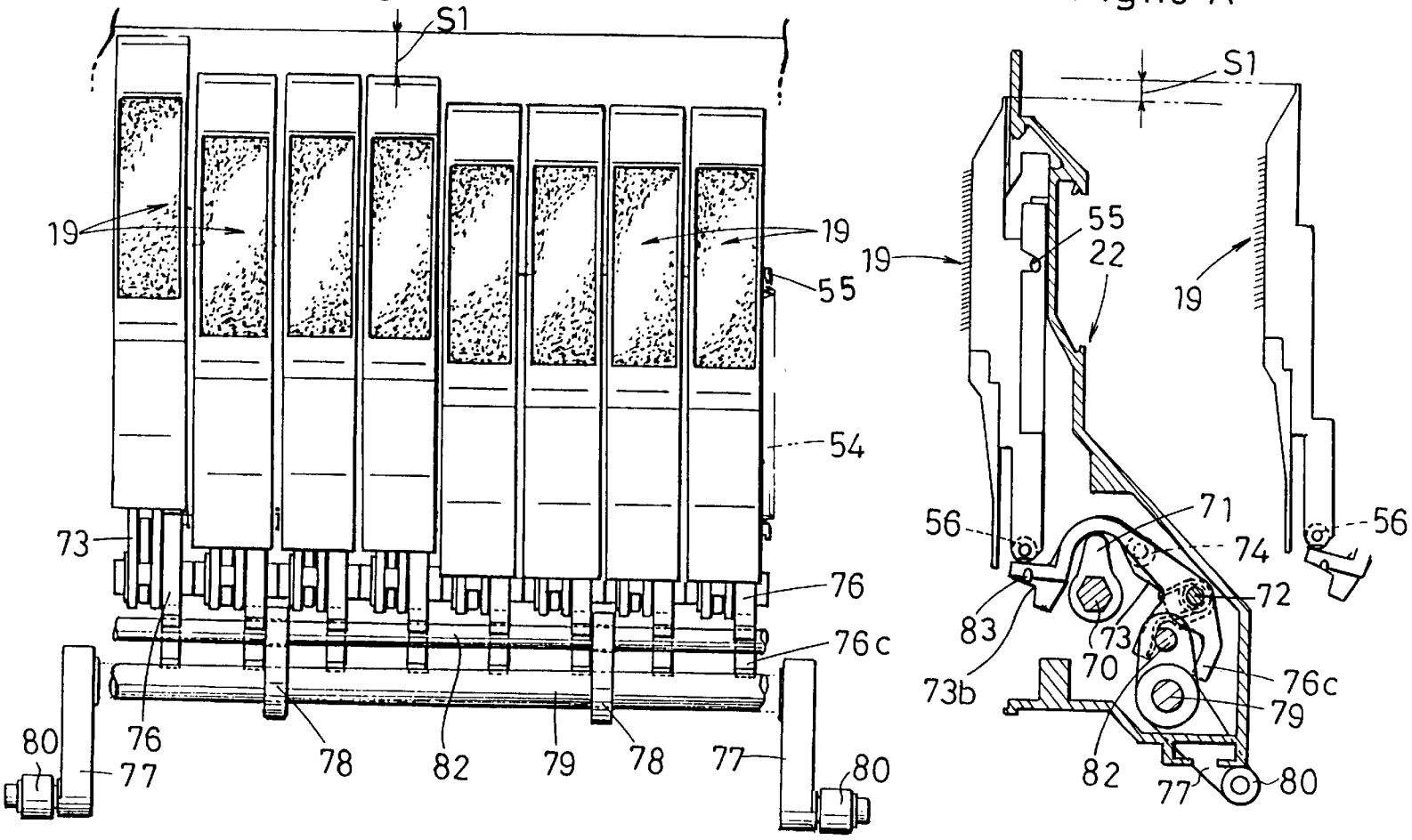
Fig.19-A
S1
19
55
22
56
71
74
72
73
70
76c
79
80
77
82
83
73b
Fig.19-B
S1
19
55
54
76
76c
80
77
78
79
82
73

Fig.22-A
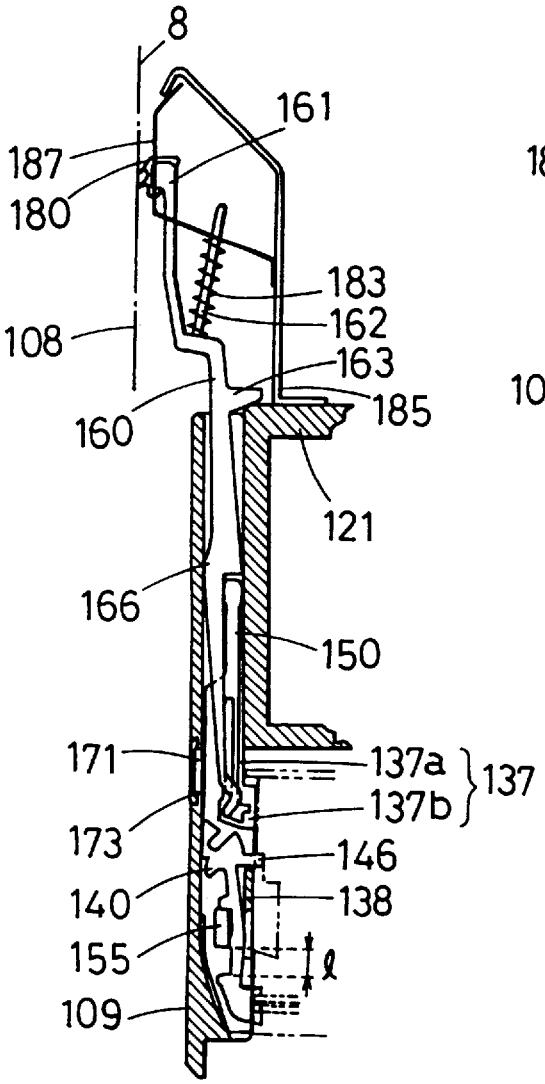
Fig.22-B
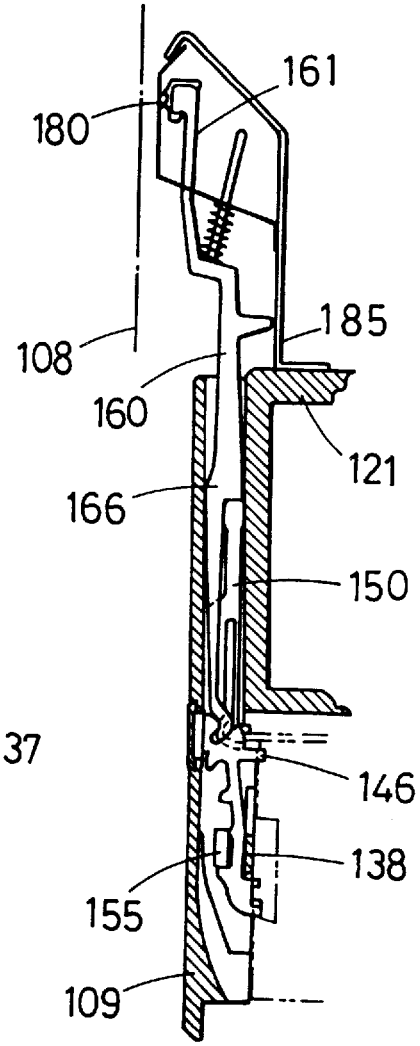

Fig. 25-A
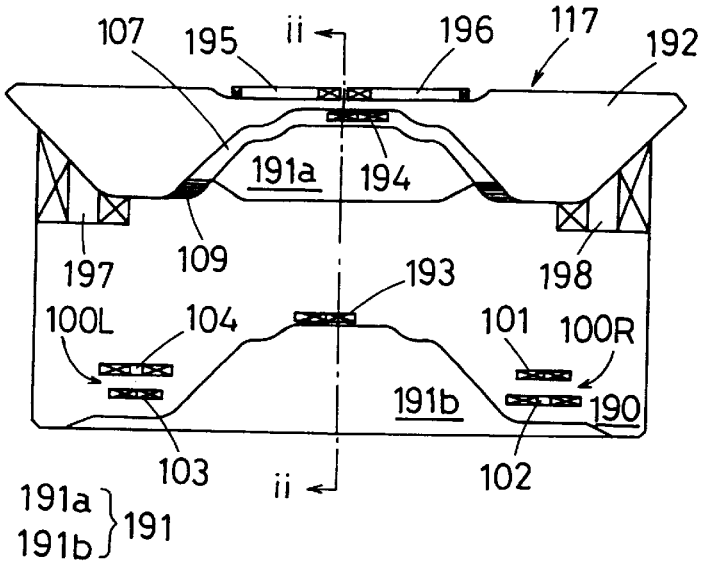
Fig. 25-B
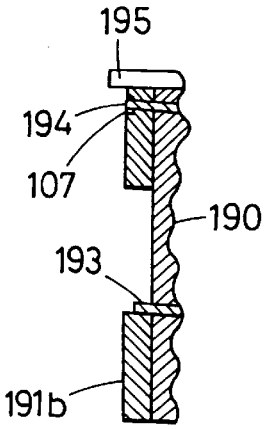
Fig. 26
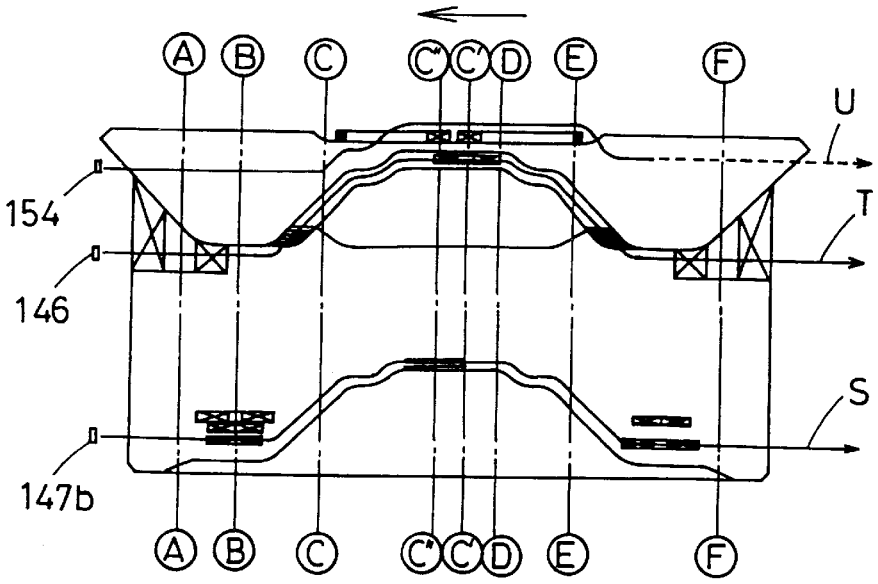

Fig.28-A
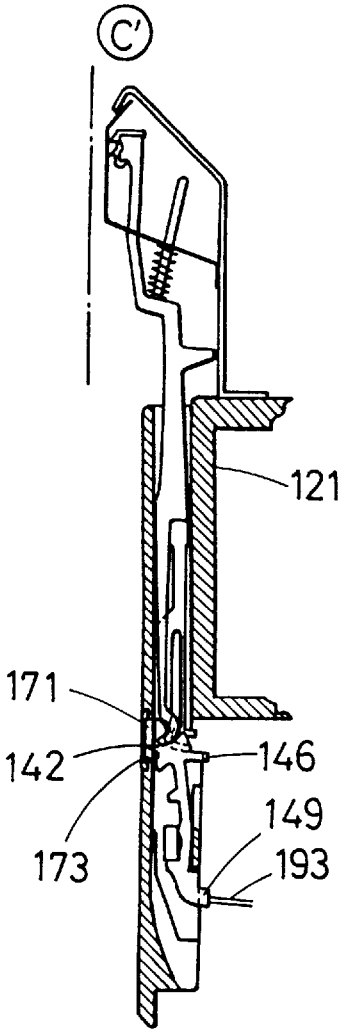
Fig.28-B
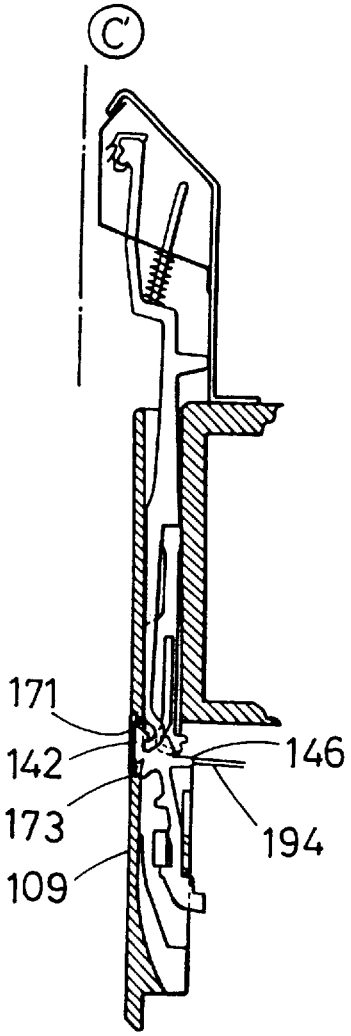

KNITTING FABRIC TAKE-DOWN DEVICE OF FLAT KNITTING MACHINE

BACKGROUND OF THE INVENTION (1) Field of the Invention

The present invention relates to a knitting fabric take-down device located under a needle bed gap between front and back needle beds of a flat knitting machine and also relates to a knitting fabric take-down device for taking down a double-wall-in-section knitting fabric having a front knitting fabric wall and a back knitting fabric wall, like a tubular knitting fabric, by use of the flat knitting machine.

(2) Description of the Prior Art

Generally, a flat knitting machine has at least a pair of spaced apart, opposite, front and back needle beds and knitting fabric take-down devices, located under the needle bed gap between the needle beds, for taking down a knitting fabric knitted with needles on the needle beds. A general type of knitting fabric take-down device for taking down a knitted fabric, especially for taking it down uniformly over a whole width of the knitting fabric, to deal with a formation knitting and a stereoscopic knitting is disclosed in, for example, Japanese Patent Publication No. Sho 57(1982)-55815.

With the device disclosed by the abovesaid prior art, a plurality of driving flaps (hereinafter it is referred to as "take-down members") are arranged in parallel at one side of the knitting fabric take-down devices facing each other across a knitting fabric passageway under the needle bed gap, and knitting fabric contacting surfaces are arranged at the other side, facing the driving flaps (take-down members) across the knitting fabric passageway. The knitting fabric is held between the take-down members and the knitting fabric contacting surfaces. The take-down members, which act as a holding portion subjected to a spring preload to be swingable within a limited range around a pivot shaft extending in a vertical direction of the needle beds, are selectively operated by a raising and lowering device so that when the take-down members are lowered, the knitted fabric can be pulled out downward along the knitting fabric contacting surfaces, and held between the free edges of the take-down members and the knitting fabric contacting surfaces.

This type of device has an advantage of enabling the knitted fabric to be flexibly taken down by controlling the drive of the respective take-down members, with the result that even a stereoscopic knitting fabric can be surely taken down in a desired uniform state along its entire knitting width.

However, in this conventional type take-down device, since the take-down members are always subjected to the preload from the springs, they are pressed against the knitting fabric contacting surfaces, whether or not the knitting fabric exists between the take-down members and the knitting fabric contacting surfaces. This structure by which the take-down members are forced to be always in the above positions can present problems when the knitting fabric is moved transversely in racking operations of the needle beds or transference operations of knitted loops or when holes are formed in specified locations of the knitting fabric.

Also, Japanese Laid-Open Patent Application No. Hei 2(1990)-210046 discloses a knitting machine with a knitting-out device movable up and down along a knitting fabric passageway, and it is capable of capturing the first knitting part of the knitting fabric and transferring the same to the take-down device arranged thereunder. However, this known knitting machine can present a problem in that it is difficult to provide a passageway for the knitting-out device.

Recently, a producing method, what is called a non-sewn knit, has attracted attention, in which sleeves or front and back bodies of a knitted clothing such as a sweater are knitted together at their side edges in a knitting width direction, so as to be formed into a tubular form with a double wall in section, thereby omitting the sewing process after knitting and obtaining a fully stretchable knitting clothing.

However, the front side body and the back side body knitted into a tubular body are not necessarily symmetric about the form and the number of courses of loops, for the reasons that the front and back knitted fabrics must be taken down according to their form and number of courses of loops. With this conventional type take-down device designed to sandwich the knitting fabric between front and back, there was a disadvantage that the knitting fabric could not be taken down adequately.

SUMMARY OF THE INVENTION

It is accordingly an object of the invention to provide a knitting fabric take-down device for a flat knitting machine enabling an engagement of the take-down device with the knitting fabric to be released as required, to prevent the above-mentioned problems from arising in the knitting of the knitting fabric.

Another object of the invention is to provide the knitting fabric take-down device for the flat knitting machine thereby enabling capture and release of the knitting fabric by the take-down members to be facilitated.

Still another object of the invention is to provide the knitting fabric take-down device of the flat knitting machine enabling a force required for taking down the knitting fabric as captured by the knitting fabric capturing surfaces to be freely set at any desired value according to types of knitting fabrics and knitting conditions.

A further object of the invention is to provide the knitting fabric take-down device particularly available for individually taking down the front knitting fabric and the back knitting fabric of the knitting fabric knitted into a double wall in section like a tubular knitting fabric.

To accomplish the above-mentioned objects, the present invention has been made. The present invention is directed to knitting fabric take-down devices, located in front and back of and facing each other across a knitting fabric passageway formed under a needle bed gap between at least a pair of front and back needle beds of a flat knitting machine, for taking down a knitting fabric. Each knitting fabric take-down device comprising front knitting fabric take-down means for capturing only a front part of the knitting fabric in the knitting fabric passageway and taking it down; back knitting fabric take-down means for capturing only a back part of the knitting fabric and taking it down; and a take-down force adjusting mechanism for adjusting a take-down force of each of the knitting fabric take-down means, the front and back knitting fabric take-down means each comprising a plurality of take-down members which are arranged along a longitudinal direction of the needle beds and are each adapted to be sequentially or individually actuated to take down the knitting fabric in the knitting fabric take-down operation.

According to this invention, since the front and back knitting fabrics knitted into a tubular knitting fabric in the needle beds at front and back portions of the flat knitting machine are each taken down by the individual knitting fabric take-down means, even a knitting fabric whose front body and back body are different in shape from each other is taken down properly.

It is preferable that the knitting fabric take-down devices of the present invention are provided with a knitting fabric take-down device open-close mechanism which controls the front and back knitting fabric take-down means to move away from and close to each other in association with or in isolation from the front and back knitting fabric take-down means. Also, it is desirable that a take-down actuating portion of the knitting fabric knitting take-down means is composed of a raising and lowering member having, at a part thereof facing the knitting fabric, a knitting fabric capturing surface which is formed into a shape capable of capturing the knitting fabric when lowered and releasing the knitting fabric when raised. Preferably, the knitting fabric capturing surface is fitted to the body of each of the take-down members via an elastic member.

With this construction, the capture and release of the knitting fabric can be performed by simply moving the raising and lowering member up and down in the same plane, and even when a transverse force is applied to the knitting fabric by, for example, racking, the knitting fabric can be removed from the knitting fabric capturing surfaces without scratching the knitting fabric.

Further, it is desirable that the knitting fabric capturing surface of the knitting fabric take-down means is biased in a direction of projecting from a body of the take-down member and is so structured that in an inactive mode it can be retracted in such a position as to be kept from projecting from the body of the take-down member on the side facing the knitting fabric, or in such a manner as to reduce the projection therefrom.

With this construction, when the knitting fabric take-down means are in an inactive mode, the knitting fabric capturing surfaces can be prevented from contacting with the knitting fabric, hooks and the like, when knitted out.

The knitting fabric capturing surface may be formed by a plurality of needles which are planted in a surface of a base vertically or at specified angles and are bent at intermediate portions thereof or at positions near to foremost end portions thereof to point obliquely downward.

With this construction, the capture and release of the knitting fabric is automatically performed by simply moving the knitting fabric capturing surfaces up and down in the same plane.

Preferably, the take-down members and the take-down force adjusting means may be connected with each other via elastic members, and an elastic member connecting portion of each of the take-down force adjusting means is changed in position to vary a resilient force of each of the elastic members, to render the knitting fabric take-down force of the knitting fabric capturing surfaces variable.

With this construction, a force of the knitting fabric capturing surfaces required for taking down the knitting fabric can be freely set at an optimum value to suit the type of knitting fabrics.

Further, the take-down means may include a take-down claw bed arranged in parallel with a lengthwise dimension of the needle beds; selectors, take-down claw jacks and the take-down claws which are fitted in a number of accommodating grooves formed in the take-down claw bed; biasing means for biasing the take-down claws downwards; a carriage movable in reciprocation in a widthwise direction of the take-down claw bed; selecting means, mounted on the carriage, for selecting any desired take-down claws from the take-down claws; and cam means, provided in the carriage, for raising the selected take-down claws by the selecting means.

It is preferable that the take-down claws are biased downwards and the selectors and the take-down claws are engaged with each other at their engaging portions to swing the claws in a direction of foremost end portions of the claws moving away from the knitting fabric, to allow the claws to be disengaged therefrom, and then after the take-down claws are raised with keeping their engagement with the selectors, the selectors are lowered to be released from the engagement with the take-down claws, to swing claws of the take-down claws toward the knitting fabric, to allow the claws to capture the knitting fabric.

The capture of the knitting fabric may be effected by use of a suction means to vacuum the knitting fabric.

Further, the present invention is directed to knitting fabric take-down devices of a flat knitting machine including at least a pair of, spaced apart, opposing, front and back needle beds and knitting fabric take-down means for capturing a knitting fabric which is in a knitting fabric passageway formed under a needle bed gap between the front and back needle beds and taking it down, the knitting fabric take-down means being formed by a plurality of take-down members which are arranged along a longitudinal direction of the needle beds and are each adapted to be sequentially or individually actuated to take down the knitting fabric in the knitting fabric take-down operation.

Each of the take-down members of the knitting fabric take-down means is provided, at a body part thereof facing the knitting fabric, with a knitting fabric capturing surface, which is formed into a shape capable of capturing the knitting fabric when lowered and releasing the knitting fabric when raised; and, the knitting fabric capturing surface is biased in a direction projecting from the body of the take-down member and is so structured that in its inactive mode it can be retracted in such a position as to be kept from projecting from a side of the body of the take-down member, or in such a manner as to reduce the projection therefrom.

With this construction, the knitting fabric capturing surfaces of the take-down members of the knitting fabric take-down means, when lowered, are allowed to capture the knitting fabric knitted in the needle beds of the flat knitting machine and raise it, and are allowed to release it when raised. Also, when a part of the knitting fabric requiring no take-down operation is knitted, the knitting fabric capturing surfaces of the take-down members are allowed to be retracted in a position away from the knitting fabric to be kept from contacting with it, if necessary.

It is preferable that the knitting fabric capturing surface is formed by a plurality of needles which are planted in a surface of a base vertically or at specified angles and are bent at intermediate portions thereof or at positions near to foremost end portions thereof to point obliquely downward.

With this arrangement, the capture and release of the knitting fabric can be automatically performed by simply moving the knitting fabric capturing surfaces up and down in the same plane. It is desirable that the knitting fabric capturing surfaces are fitted to the bodies of the take-down members via the elastic members, by virtue of which the knitting fabric capturing portions are allowed to be shifted to a knitting fabric releasing portion via a tensile force resulting from the knitting fabric when moved transversely, to release the knitting fabric.

Desirably, the take-down members are connected with the take-down force adjusting means for adjusting a take-down force of the take-down means via elastic members, and an elastic member connecting portion of each of the take-down force adjusting means is changed in position to vary a resilient force of each of the elastic members, to render the knitting fabric take-down force of the knitting fabric capturing surfaces variable.

With this construction, a force required for the knitting fabric capturing surfaces to take down the knitting fabric is freely set at any desired value according to the types of knitting fabrics and knitting conditions.

BRIEF DESCRIPTION OF THE DRAWINGS

FIG. 11-A is a side view of a knitting fabric capturing surface; FIG. 11-B is an enlarged view of the same; and FIG. 11-C is an enlarged plan view of the same;

FIG. 12 is a side view of a modification of the knitting fabric capturing surface;

FIG. 13 is a side view of a further modification of the knitting fabric capturing surface;

FIG. 14-A is a side view of a raising cam; and FIG. 14-B is a front view of the same;

FIG. 15-A is a side view of a raising lever; FIG. 15-B is a plan view of a raising cam lever; and FIG. 15-C is a front view of the raising lever;

FIG. 16-A is a side view of the raising lever; FIG. 16-B is a plan view of the same; and FIG. 16-C is a front view of the same;

FIG. 17-A is a side view showing the knitting fabric capturing surface retracted in place at the vicinity of an upper limit; and FIG. 17-B is a front view showing the knitting fabric capturing surface retracted in place at the vicinity of the upper limit;

FIG. 18-A is a side view showing a basic stroke of the knitting fabric capturing surface; and FIG. 18-B is a front view showing a basic stroke of the knitting fabric capturing surface;

FIG. 19-A is a side view showing an action of the knitting fabric capturing surface when an amount of taking down the knitting fabric is adjusted; and FIG. 19-B is a front view showing an action of the knitting fabric capturing surface when an amount of taking down the knitting fabric is adjusted;

FIG. 22 shows sectional views of the take-down claw bed, FIG. 22-A showing the take-down claw as lowered; and FIG. 22-B showing the same as raised;

FIG. 25 shows a knitting fabric take-down cam carriage, and specifically FIG. 25-*a* shows a perspective view of a cam arrangement of the cam carriage for take-down a knitting fabric; and FIG. 25-B shows a sectional view of the same taken in the direction of the arrows on line ii—ii in FIG. 25-A;

FIG. 26 is a view showing the knitting fabric take-down cam carriage in the transverse to the left;

FIG. 28-A is the take-down claw of the cam carriage in the active mode in the phase C" of FIG. 26; and FIG. 28-B is the take-down claw of the cam carriage in the phase C' of FIG. 26.

DETAILED DESCRIPTION OF THE PREFERRED EMBODIMENT

Referring now to the accompanying drawing figures, an example of the preferred embodiments of the present invention is described below.

(First Embodiment)

Figure 1:
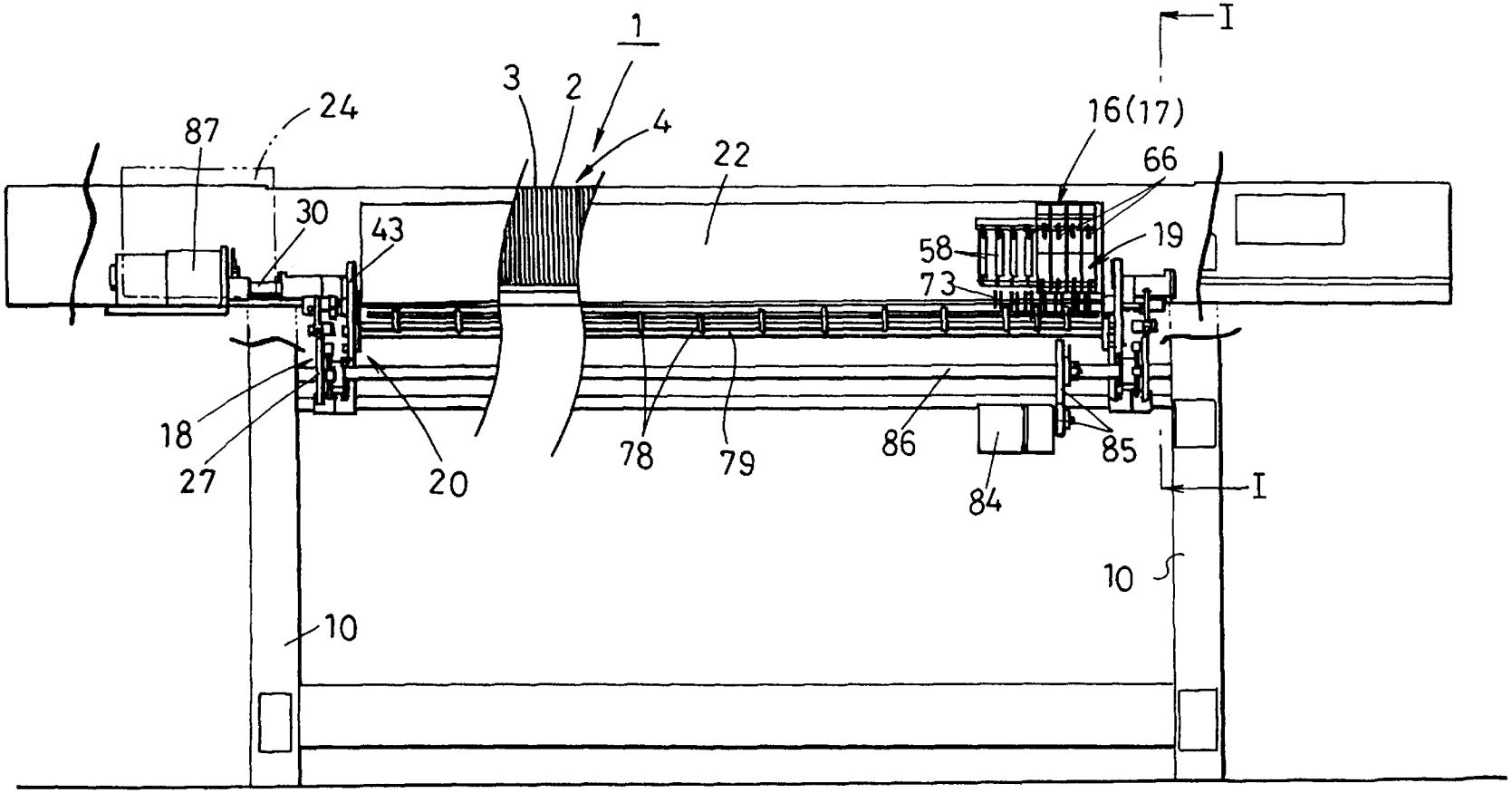
FIG. 1 is a partially cutout front view of a flat knitting machine fitting thereto a knitting fabric take-down device of the first embodiment.
Figure 2:
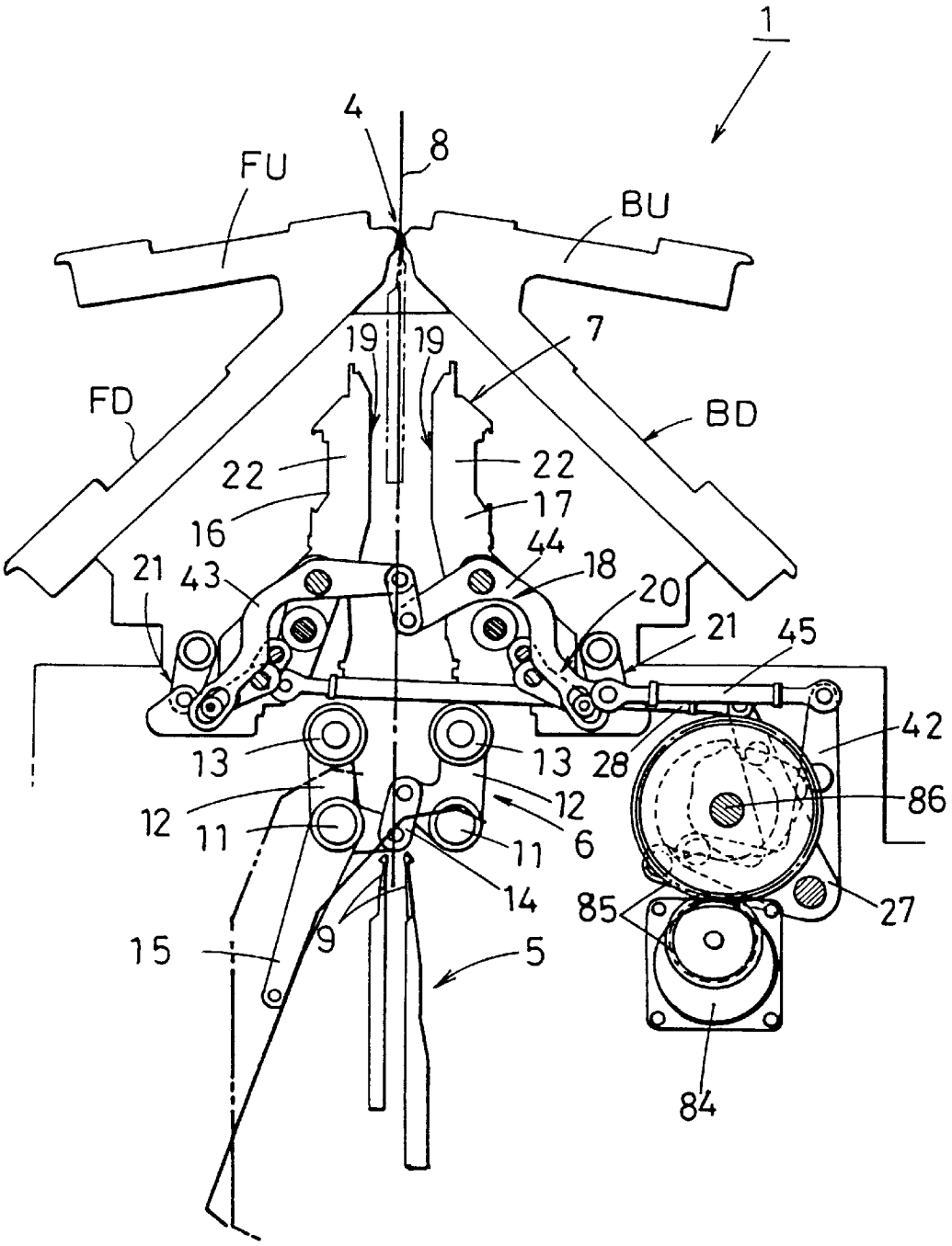
FIG. 2 is a sectional view of the same taken along the line A—A of FIG. 1.

FIG. 1 is a partially cutout front view of a flat knitting machine; and FIG. 2 is a sectional view taken along the line A—A of FIG. 1. A reference numeral 1 shown in the drawings designates the entirety of a flat knitting machine.

The flat knitting machine 1 includes knitting needles 2 which are so contained in needle beds 3 as to be moved back and forth in a sliding manner. The needle beds 3 are arranged in front and back, and confront each other across their needle bed gap 4. The flat knitting machine 1 further includes knitting-out device 5, arranged in the needle bed gap 4, for applying a downward tension to a knitting fabric until the knitting fabric reaches a specified length; take-down roller devices 6 with rollers which are driven to hold the knitting fabric taken down to the specified length by the knitting-out device 5 between the rollers and take it down; and knitting fabric take-down device 7 for taking down the knitting fabric in isolation with or in cooperation with the take-down roller device 6.

The knitting-out device 5, the take-down roller device 6 and the knitting fabric take-down device 7 are arranged under front needle beds (FD, FU) and back needle beds (BU,BD), sandwiching a knitting fabric passageway 8 indicated by a chain line in FIG. 2 formed in the needle bed gap 4 between the front and back needle beds.

The knitting fabric take-down device 7 of the embodiment comprises a pair of knitting fabric take-down means 16, 17 which are arranged in front and back of and confronting each other across the knitting fabric passageway 8 downstream from the needle bed gap 4, so as to advantageously take-down even a knitting fabric knitted into a tubular form by the take-down members. The term "tubular knitting fabric" used herein is intended to mean a knitting fabric with having a front knitting fabric portion retained by front needle beds and a back knitting fabric portion retained by back needle beds, so that the front and back portions are knitted together at their side edges. One of the knitting fabric take-down means 16 (17) acts to take down the front portion only of the knitting fabric and the other of the knitting fabric take-down means 17 (16) acts to take down only the rear portion of the knitting fabric.

The knitting-out device 5 is provided with a pair of hooks 9 disposed back to back to face front and back needles and a raising and lowering mechanism (not shown) for moving the hooks 9 vertically up and down between a lower position of the take-down roller devices 6 and an upper position of the front and back needles.

The take-down roller device 6 comprises opposing L-shaped brackets 12 pivotally supported to be swingable on a pair of front and back shafts 11 pivotally supported between right and left frames 10, 10 of the flat knitting machine and take-down rollers 13 pivotally supported to be rotatable at upper ends of the brackets 12. The front and back take-down rollers 13 are driven to rotate by rotation means (not shown).

The brackets 12 are connected with each other via a link plate 14 at their opposing ends on the knitting fabric passageway 8 side. One of the brackets 12 is rotated by a rotation lever 15 so that the front and back take-down rollers 13, 13 can be swingably moved close to and away from each other.

The knitting fabric take-down device 7 comprises the front side knitting fabric take-down means 16 to capture and take down only the front side knitting fabric of knitting fabric in the knitting fabric passageway 8; the back side knitting fabric take-down means 17 to capture and take down only the back side knitting fabric in the knitting fabric in the knitting fabric passageway 8, a knitting fabric take-down device open-close mechanism 18 (hereinafter it is simply referred to as "open-close mechanism") for allowing the both knitting fabric take-down means 16, 17 to move close to and away from the knitting fabric passageway 8; and a take-down force adjusting mechanism 20 for adjusting a raising and lowering motion of knitting fabric capturing surfaces 19 (as described later) of the both front and back knitting fabric take-down means 16, 17 and a take-down force thereof.

The front and back knitting fabric take-down means 16, 17 are respectively built in front and back casings 22, 22 movable close to and away from each other via a parallel link 21 as mentioned later. Thus, the front and back casings 22, 22 are selectively moved between a "close" state in which a space between the knitting fabric capturing surfaces 19, 19 confronting each other is narrowed to effect the take-down of the knitting fabric and an "open" state in which the space is opened not to effect the take-down of the knitted fabric.

Figure 3:
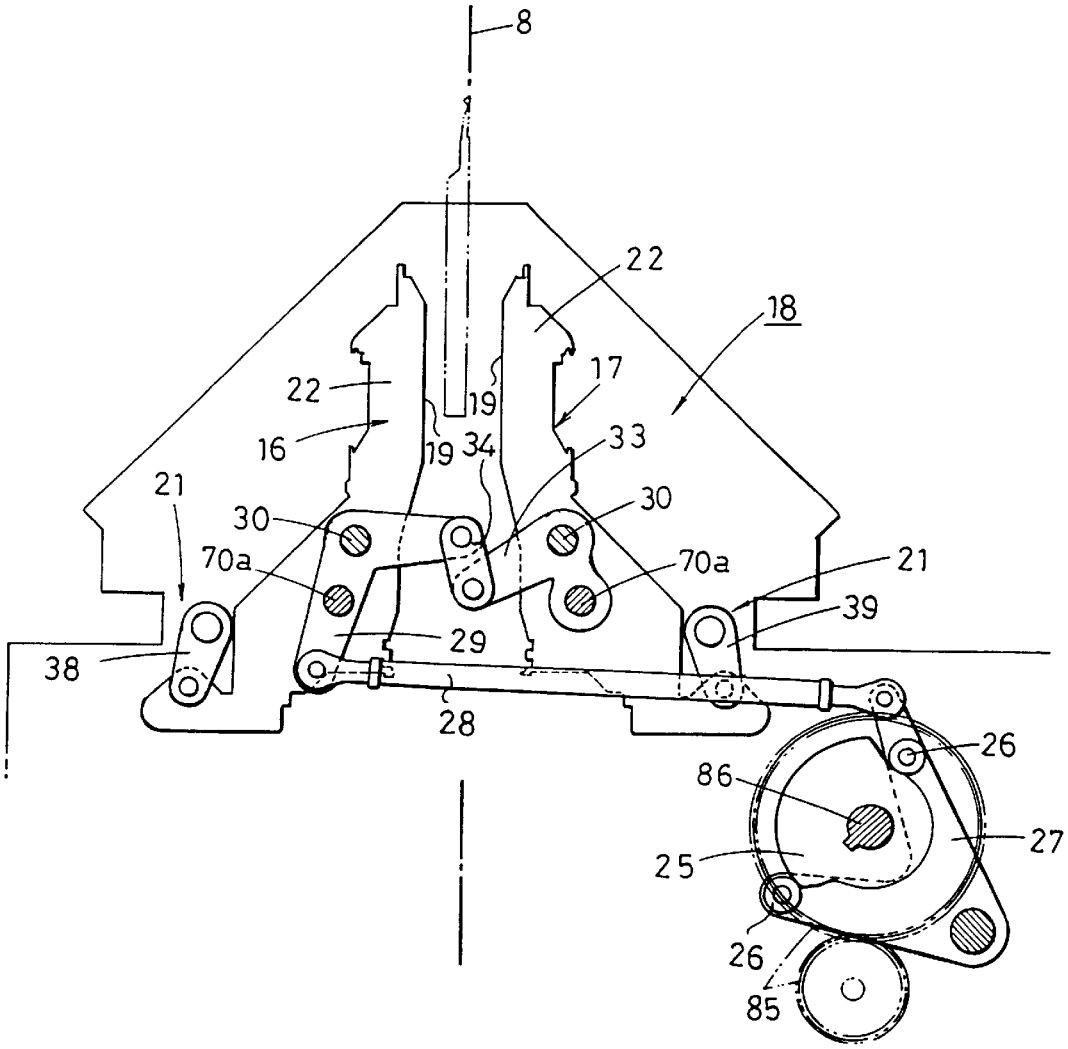
FIG. 3 is a schematic side view of an open-close mechanism for a casing.

The open-close mechanism 18 comprises a motor 84 which is controlled to rotate by a controlling unit (not shown) for controlling knitting of the flat knitting machine, a cam shaft 86 to which rotation of the motor 84 is transmitted through a gear transmission mechanism 85, so as to be driven to rotate, an open-close cam 25, see FIG. 3, fixed to the cam shaft 86, an open-close swinging bracket 27 which is swung by rollers 26 sliding over the open-close cam 25, an inverted L-shaped, front, open-close arm 29 pivotally supported on a front pivot shaft 30 via an open-close rod 28 connected to the open-close swinging bracket 27, an inverted L-shaped, back, open-close arm 33 disposed at a symmetrical position of the front open-close arm 29 with respect to the knitting fabric passageway 8 and an interlocking plate 34 connecting the open-close arms 29, 33 with each other at their ends nearer to the knitting fabric passageway 8.

The open-close cam 25 includes an opening cam surface for allowing the open-close swinging bracket 27 to be swung in a counterclockwise direction as viewed in the drawing to move the front and back casings 22, 22 away from each other, as shown in FIG. 3, and a closing cam surface for allowing the open-close swinging bracket 27 to be swung in a clockwise direction to move the front and back casings 22, 22 close to each other.

Figure 4:
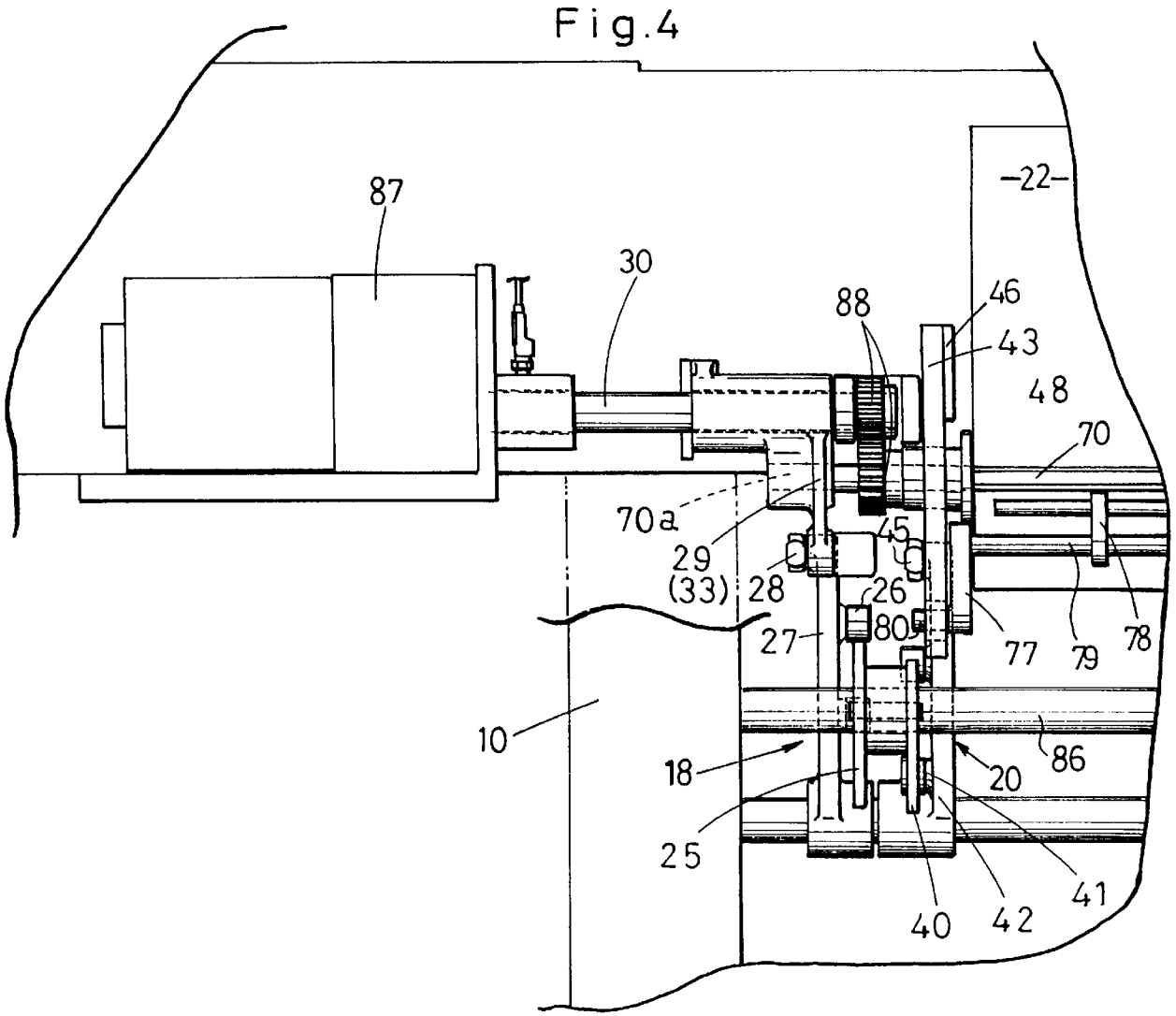
FIG. 4 is a schematic side view of a part of the open-close mechanism and a take-down force adjusting mechanism.
Figure 5:
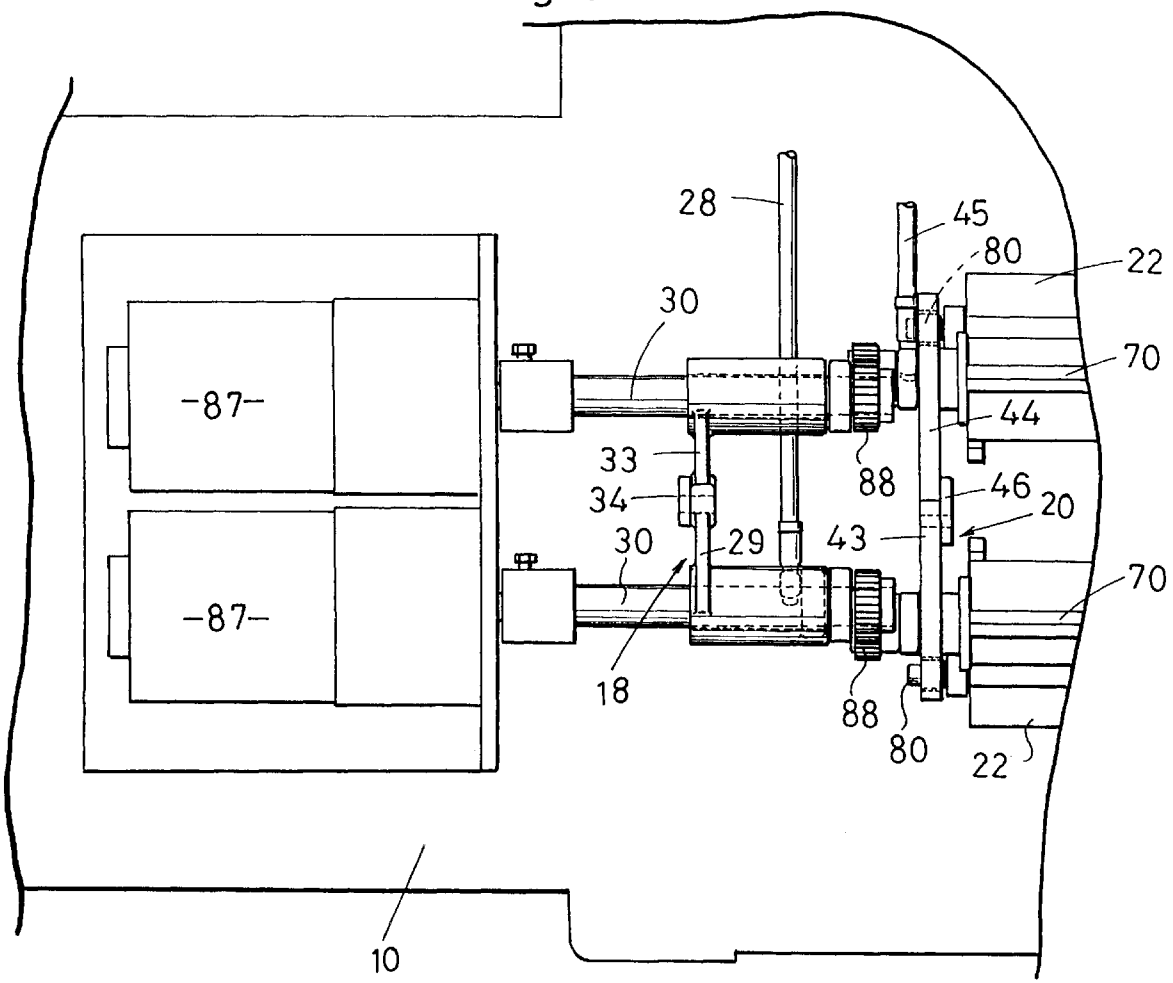
FIG. 5 is a schematic front view of a part of the open-close mechanism and the take-down force adjusting mechanism.

The front open-close arm 29 and the back open-close arm 33 are pivotally supported on the front pivot shafts 30,30 which forms output transmission shafts of driving motors 87, 87 for allowing drive shafts 70 of the take-down force adjusting mechanism 20 described later to be driven to rotate, as shown in FIGS. 4 and 5.

The front open-close arm 29 has a corner part and a joint portion to the open-close rod 28, at an intermediate portion between which an end portion 70*a* of the front drive shaft 70 of the take-down force adjusting mechanism 20 pivotally supported by the front casing 22 is pivotally supported. The back open-close arm 33 has a lower portion at which an end portion 70*a* of the back drive shaft 70 of the take-down force adjusting mechanism 20 pivotally supported by the back casing 22 is pivotally supported.

The parallel links 21 for allowing the both casings 22, 22 to move close to and away from each other include front-casing 22 use parallel links 21 which are formed by a portion of the front open-close arm 29 at the end portion 70*a* side and the link plate 38 arranged in parallel thereto; and back-casing 22 use parallel links 21 which are formed by a portion of the back open-close arm 33 at the end portion 70*a* side and the link plate 39 arranged in parallel thereto (See FIG. 3).

Figure 6:
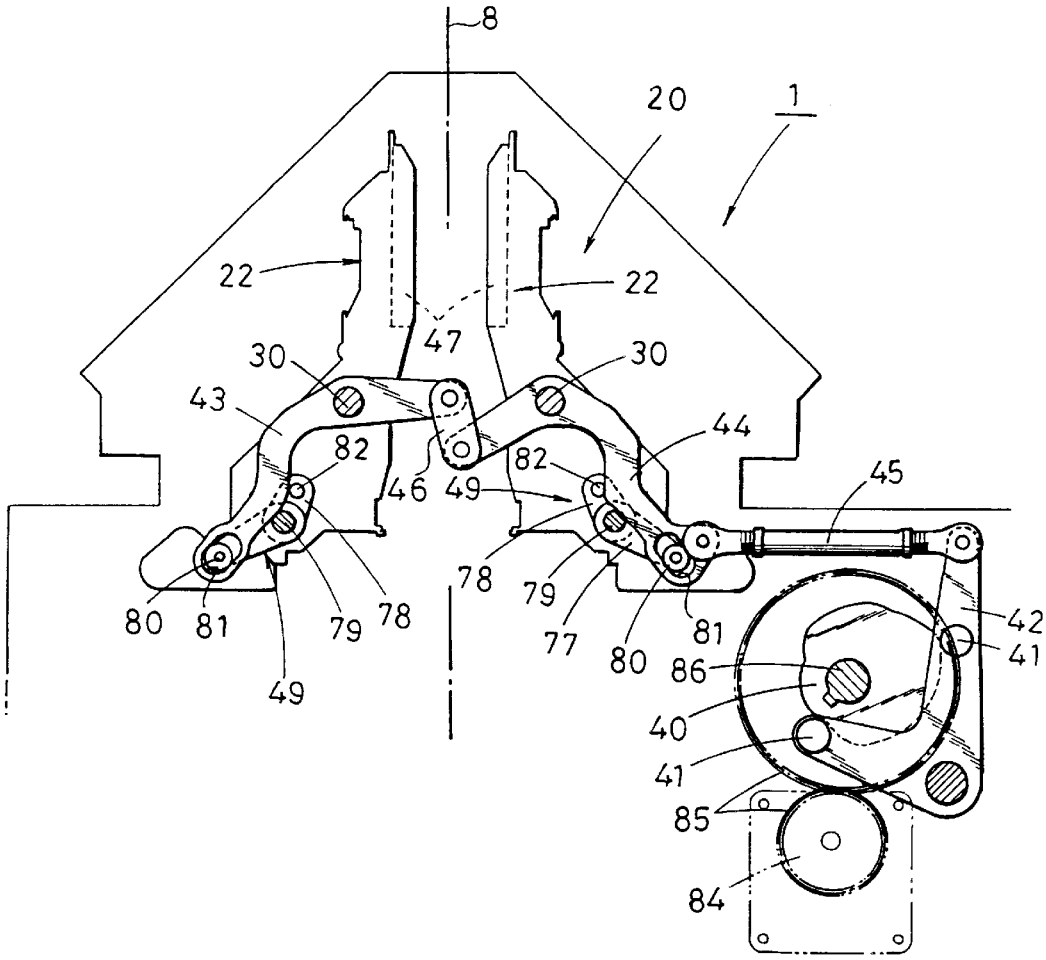
FIG. 6 is a schematic side view showing the take-down force adjusting mechanism.

The take-down force adjusting mechanism 20 comprises, as shown in FIG. 6, a motor 84 which is rotated under control of signals from a control unit (not shown) for controlling the knitting of the flat knitting machine 1; the cam shaft 86 to which rotation from the motor 84 is transmitted through the gear transmission mechanism 85, so as to be driven to rotate; a take-down force adjusting cam 40 fixed on the cam shaft 86 and rotatable with the open-close cam 25; a take-down force adjusting bracket 42 which is swung by slidable rollers 41 sliding over the take-down force adjusting cam 40; a substantially L-like shaped front arm 43 and a substantially L-like shaped back arm 44 which are pivotally supported at intermediate portions thereof by the output transmission shafts 30 and are disposed on the front and back casings 22, 22 at positions symmetrical with respect to the knitting fabric passageway 8; an adjustable-in-length connecting rod 45 for connecting a lower end of the back arm 44 and an upper end of the take-down force adjusting bracket 42; and an interlocking plate 46 for connecting the arms 43, 44 at their ends nearer to the knitting fabric passageway 8.

Figure 8:
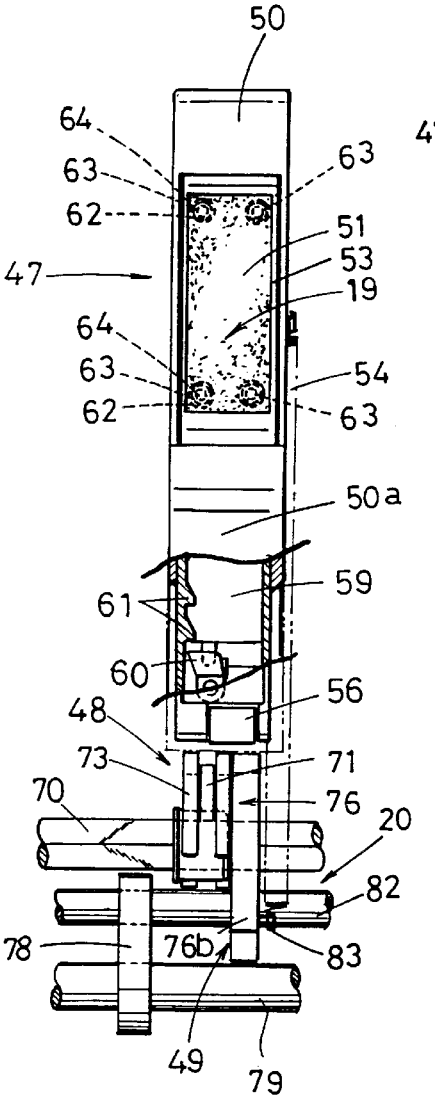
FIG. 8 is a front view of FIG. 7.
Figure 7:
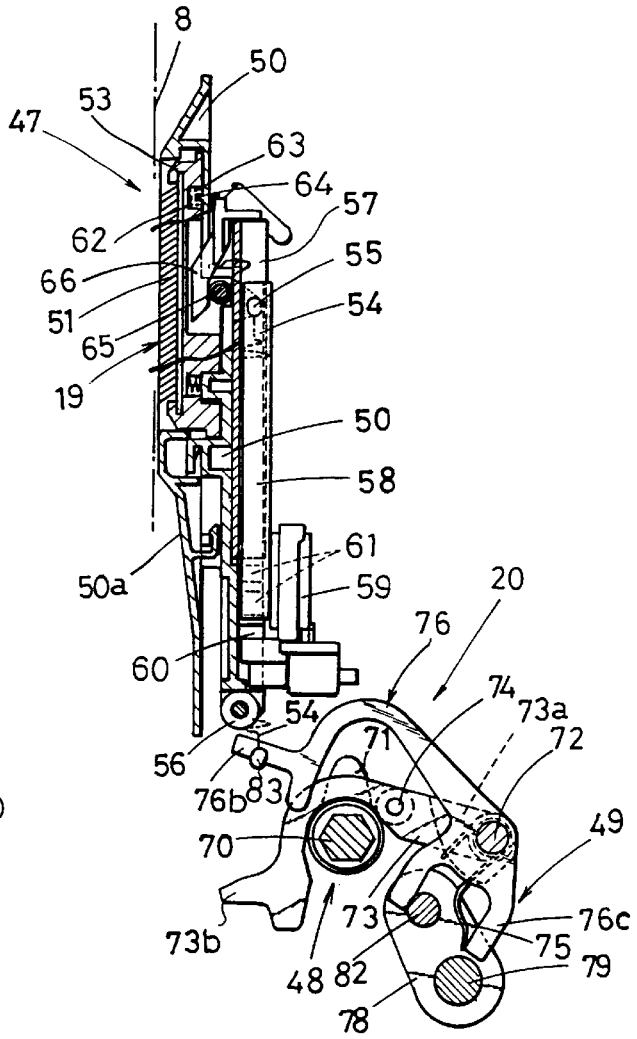
FIG. 7 is a schematic side view showing action of the mechanism of the knitting fabric take-down device including the take-down force adjusting mechanism.

The arms 43, 44 are provided, at lower end portions thereof, with a raising-and-lowering drive means 48 to raise and lower take-down members 47, 47 built in the front and back casings 22, 22 and take-down force adjusting means 49 to set take-down forces of the take-down members 47, 47 (See FIGS. 7 and 8).

Figure 9:
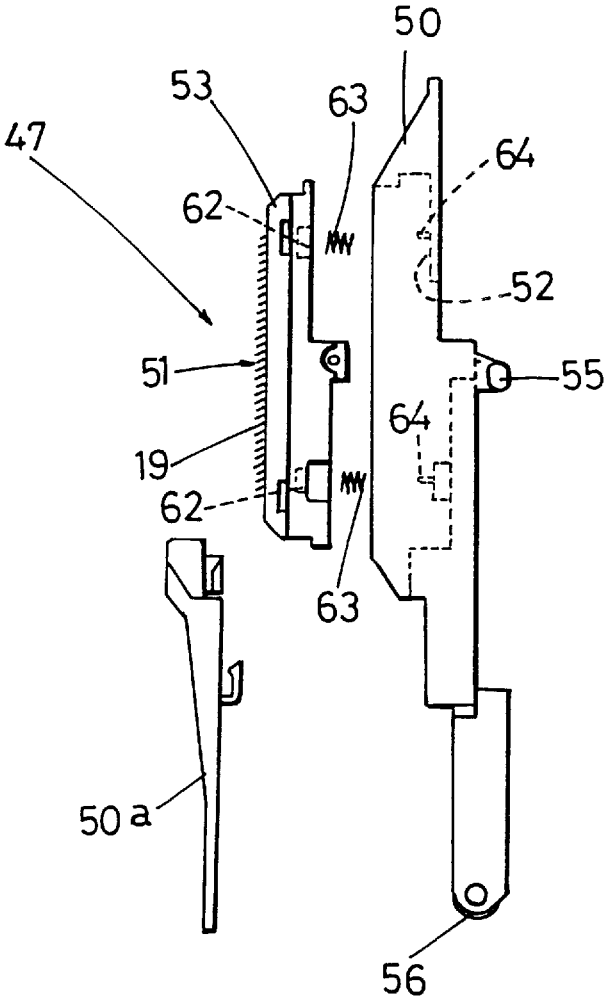
FIG. 9 is an exploded side view of a take-down member.

A plurality of take-down members 47 are arranged in parallel along a longitudinal direction of each of the front and back needle beds 3, 3, and each take-down member comprises a take-down member body 50 made of a plastic molded into a generally rectangular shape by use of an injection mold and a knitting fabric capturing surface forming member 53 fitted in the take-down member body 50 (See FIG. 9).

The take-down member body 50 is provided at its upper portion with an accommodating room 52 for the knitting fabric capturing surface forming member 53, and a spring holder holding projection 55, to which an upper end of a take-down tensile force adjusting spring 54 is engaged, is projected from one side wall of the accommodating room 52 (See FIGS. 7 and 8).

The take-down tensile force adjusting spring 54 is held at its lower end by a spring holder holding projection (an elastic member connecting portion) forming a spring retaining projection 83 provided at a force application portion 76*b* of a raising lever 76 described later. The take-down member body 50 is provided, on an inner surface of an one side portion thereof, with a two-step upper and lower engaging portions 61 with which an engaging member 60 of a solenoid 59 described later is engaged. Further, the take-down member body 50 is provided, at a lower end portion thereof, with a push-up roller 56 to which the raising-and-lowering drive means 48 and take-down force adjusting means 49 act to move the take-down member body 50 up and down.

The knitting fabric capturing surface forming member 53, which is made of a synthetic resin and is relatively heavy, is accommodated in the accommodating room 52 of the take-down member body 50, forming a knitting fabric capturing surface thereon. The knitting fabric capturing surface forming member 53 is prevented from being drawn out by a protector 50*a* fitted to a lower portion of the take-down member body 50.

The solenoid 59 is provided on the back of a slide bearing 58 fixed to the casing 22 at the knitting fabric passageway 8 side, as shown in FIGS. 7 and 8. Operations of the solenoid 59 will be described below.

The solenoid 59 is controllably switched between ON and OFF under control of signals from the controlling unit. The solenoid 59 is normally in OFF mode in which an application of current is cut and the engaging member 60 of the solenoid 59 is disengaged from the engaging portion 61 provided at the back of the take-down member body 50, to allow the take-down member body 50 to be slid vertically.

When the solenoid 59 is switched into ON mode through the application of current, the engaging member 60 of the solenoid 59 is tilted in an engaging direction and is brought into engagement with any one of upper and lower engaging portion 61 at the take-down member body 50.

When the knitting fabric capturing surface forming member 53 is raised to a position in the vicinity of an upper limit, with the engaging member 60 of the solenoid 59 being engaged with the lower engaging portion 61, the knitting fabric capturing surfaces 19 are fixed in a "retracted" state in which the knitting fabric capturing surfaces 19 is retracted into the casings 22. When the engaging member 60 of the solenoid 59 is engaged with the upper engaging portion 61, the knitting fabric capturing surfaces 19 come into a "rested" state in which the knitting fabric capturing surfaces 19 are projected from the casings 22 not to be raised or lowered vertically.

These "retracted" and "rested" states will be described later. The vertical sliding motion of the elevate take-down members 47 is thus controllably stopped and released from the stop by switching the solenoid 59 between ON and OFF. The knitting fabric capturing surface forming member 53 has spring accommodating recesses 62 bored in the back thereof at four corners, as shown in FIGS. 7 and 8. Coiled springs 63 fitted in the spring accommodating recesses 62 are fitted to spring holding projections 64 projected from a bottom of the accommodating room 52 of the take-down member body 50. The coiled spring 63 bias the knitting fabric capturing surfaces 19 toward the knitting fabric passageway 8 so that the front surface of the knitting fabric capturing surfaces 19 can project toward the knitting fabric passageway 8.

Thus, the knitting fabric capturing surfaces 19 biased by the coiled springs 63 provided at four corners of the back surface of the knitting fabric capturing surface forming member 53 are allowed to selectively engage with or disengage from a knitting fabric under knitting via tensile forces of the coiled springs 63 properly, even when the knitting weave is changed in the course of the knitting to increase the thickness of the knitting fabric or when a knitting yarn is changed in yarn count.

The knitting fabric capturing surfaces 19 biased and pushed by the tensile forces of the coiled springs 63 are tilted against the coiled springs 63 in a direction for the knitting fabric to be easily detached therefrom, when a transverse force is applied to the knitted fabric by, for example, a racking of the needle beds 3 or a narrowing of the knitting fabric. Thus, the knitting fabric capturing surfaces 19, combined with the shape of needles 51 described later, enables the knitting fabric to be released therefrom easily.

At a center part of the back of the knitting fabric capturing surface forming member 53, a horizontally supported roller 65 is disposed with a certain distance from the back surface of the knitting fabric capturing surface forming member 53.

On the other hand, a downward hook-like take-down part 66 extends from the front and back casings 22, 22 side into a space between the roller 65 and the back of the knitting fabric capturing surface forming member 53 at the center part thereof.

Figure 10:
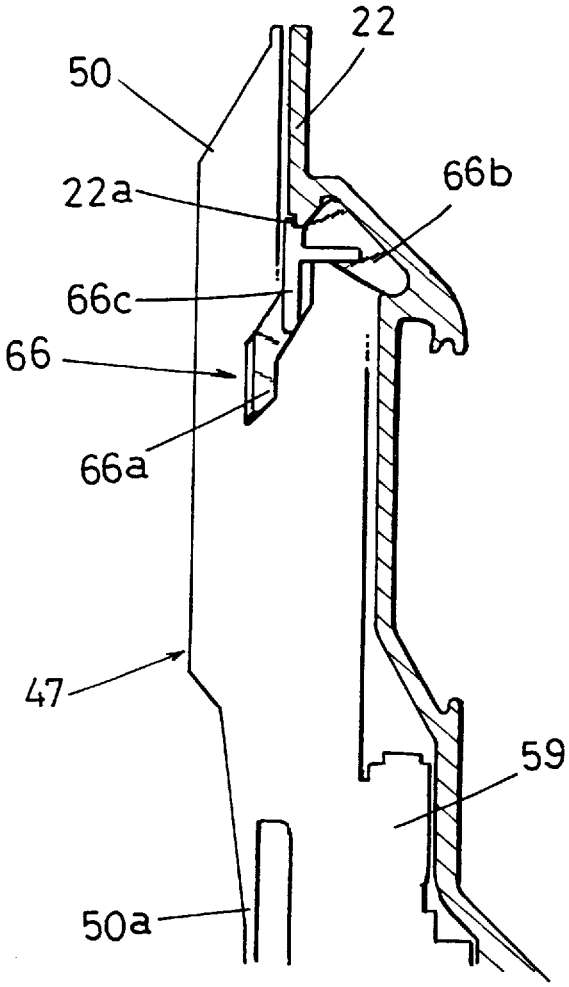
FIG. 10 is a schematic side view of a part of a take-down member.

The downward hook-like take-down part 66, see FIG. 10, is provided with a downward projecting hook 66*a* formed thereon; a fixing portion 66*b* fitted in an upper end space at an upper end portion of each of the casings 22 and extending from the upper end of the hook 66*a* toward the back thereof; and a fixing portion 66*c* integrally formed with and provided between the hook 66*a* and the fixing portion 66*b* and abutting against an upper edge portion 22*a* of each of the casing 22 at the front side thereof to stabilize the take-down part 66.

Thus, when the fixing portion 66*b* of the take-down part 66 is fitted into the upper edge portion of the each casing 22 until the fixing portion 66*c* is brought into abutment with the upper edge of the each casing 22 at the front side, the hook-like take-down part 66 is surely fixed to the casing 22 at a location near to the upper end thereof. When the take-down member 47 is raised up to the vicinity of the uppermost end, the roller 65 is pulled into the casing 22 via the downward hook-like take-down part 66 projected from the casing 22, to allow the knitting fabric capturing surface 19 to be retracted toward the casing 22 against the elastic force of the coiled spring 63, as shown in FIG. 7.

The knitting fabric capturing surface 19 comprises a flexible base 69 formed of canvas 67 coated with rubber 68 or the like and needles 51 planted densely in the base 69, as shown in FIG. 11. The needles 51 are projected from the base 69 upwardly with respect to the surface of the base 69, and are bent at their intermediate portions so that their foremost ends point downward. The foremost ends of the needles 51 are each chamfered at the upper edges and formed into tapered tips by cutting at the foremost end surfaces.

The needles 51 thus formed in the knitting fabric capturing surface 19 provides the advantage that the knitting fabric can be surely held by the needles when a tensile force from the knitting fabric acts on the needles 51 in an upward direction (in the direction C in the drawing, see FIG. 11-B,) and can be smoothly released from the needles with little resistance when the tensile force from the knitting fabric acts on the needles 51 in a downward direction (in the direction D in the drawing), as shown in FIG. 11-B.

Further, when the tensile force from the knitting fabric acts on the needles 51 in a transverse direction (in the direction E in the drawing), the knitting fabric is released from the needles 51 via elastic deformation of the base 69 and deflection of the needles 51.

It is noted here that the needles 51 may of course be for such a manner that after being embedded upright into the base 69, the needles are bent at their intermediate portions so that the foremost ends point obliquely downward. Further, the needles 51 may of course be formed in such a manner as to be protruded from a plate-like member, as shown in FIG. 12, or in such a manner that the plate-like member is serrated to form needles 51 forming the knitting fabric capturing surface 19, as shown in FIG. 13. When the needles 51 are made of the plate-like member, as shown in FIGS. 12 and 13, the needles may be integrally molded out of a synthetic resin.

Next, description will be given below on a raising and lowering motion of the take-down members 47 built in the casings 22, 22 and on the take-down force adjusting mechanism 20 for adjusting the raising and lowering amount.

The take-down force adjusting mechanism 20 comprises the raising-and-lowering drive means 48 and the take-down force adjusting means 49, as shown in FIGS. 7 and 8.

As shown in FIGS. 4 and 5, the raising-and-lowering drive means 48 is provided for each of the pair of front and back drive motors 87 at the left side of the frame 10 and each of the front and back casings 22, 22. Each raising-and-lowering drive means 48 comprises the hexagonal drive shaft 70 supported at an end thereof 70*a* by the open-close arm 29; gear transmission means 88 for transmitting rotation of the drive motor 87 to the drive shaft 70 through the output transmission shaft 30; a raising cam 71 mounted on the drive shaft 70 to be actuated in response to the push-up roller 56 of the take-down member 47 as shown in FIGS. 7 and 8; a raising lever 73 associated in operation with the push-up roller 56; and a push-up roller 74 provided at an intermediate portion of the raising lever 73.

Each raising cam 71 has a cam contour 71*b* protruding from a base in which a hexagonal bore 71*a* is formed to be fittingly engageable with the hexagonal drive shaft 70, as shown in FIG. 14. The raising cams 71 are arranged in association with the take-down members 47, 47, . . . , with every five of the take-down members 47 formed as a unit, and are fittingly mounted on the hexagonal drive shaft 70, with the neighboring cam contours 71*b* shifted in phase from each other at 60°.

The raising lever 73 has at its intermediate portion a slit 89 within which the cam contour 71*b* of the raising cam 71 is allowed to rotate, as shown in FIGS. 15-A, 15-C, and in which the push-up roller 74 is rotatably disposed.

The raising lever 73 is pivotally supported on a pivot shaft 72 arranged in parallel with the drive shaft 70 (See FIGS. 7, 8) at its base end 73*a* at which a helical spring 75 is provided. The raising lever 73 has a tip end 73*b* extended in arch from the base end 73*a* to be associated in operation with the push-up roller 56.

The helical spring 75 acts to adjust the take-down force of the knitting fabric capturing surface 19, together with the take-down tensile force adjusting spring 54.

The raising cam 71 and the raising lever 73 are fittingly mounted on the hexagonal drive shaft 70, with every five of the take-down members 47, arranged along the longitudinal direction of the needle beds 3, formed as a unit and those individual take-down members 47 shifted in phase from each other at 60°. Thus, the cam contours 71*b* are respectively formed on five surfaces of the six surfaces of the hexagonal drive shaft 70. One surface left on the hexagonal drive shaft 70 forms a rest surface for allowing no raising levers 73 to be swung, or for allowing the drive motor 87 to be stopped.

When the drive motor 87 is stopped in the rest surface, all the take-down members 47 are kept in the state in which the knitting fabric is held by the knitting fabric capturing surfaces 19 and come to a state in which the knitting fabric is allowed to be taken down by the knitting fabric capturing surfaces 19.

The drive motors 87 are controlled to change in rotation speed or stop, in match with the relationship between the knitting speed of the knitting fabric and the basic stroke S of the knitting fabric capturing surface forming members 53 shown in FIG. 18.

For example, when the knitting speed of the knitting fabric is slow, the drive motors 87 are controlled not to rotate constantly or controlled to rotate at low speed at the rest position. On the other hand, when the knitting speed of the knitting fabric is fast, the drive motor 87 is rotated constantly.

The take-down force adjusting means 49 is formed by the raising lever 76 which is controlled to rotate by the front arm 43 and the back arm 44 of the take-down force adjusting mechanism 20.

The raising lever 76 has the force application portion 76*b* to push up the push-up roller 56 of the take-down member 47 at the foremost end portion extended in arch from the pivot part 76*a* of the lever 76 being pivotally supported by the pivot shaft 72 of the raising lever 73, as shown in FIG. 16. The force application portion 76*b* is provided, at its side surface, with a spring holder holding spring retaining projection 83 projected from the side surface. Also, the raising lever 76 has, at a position below the pivot part 76*a*, a fork end 76*c* which is operated by a swinging shaft 82 for operating the take-down force adjusting mechanism 20.

The swinging shafts 82 are disposed at upper end portions of operating levers 78 fitted to operating shafts 79, as shown in FIGS. 6 and 7. The operating levers 78 allow sliders 80, which are provided at end portions of interlocking levers 77 fitted to the operating shafts 79 and fitted into elongate holes 81 formed in the lower ends of the both arms 43, 44 of the take-down force adjusting mechanism 20, to slidably move along the elongated holes 81. When the motor 84 is controllably driven to swing the front and back arms 43, 44 via the gear transmission mechanism 85, the cam shaft 86, the take-down force adjusting cam 40, the take-down force adjusting bracket 42 and the connection rod 45, the operating shafts 79 are controllably rotated by the interlocking levers 77 (See FIG. 6).

Thus, the open and close of the casings 22, 22 are controlled by the open-close mechanism 18 constructed as mentioned above, and the take-down amount and force of the take-down members 47 are controlled by the take-down force adjusting mechanism 20 constructed as mentioned above. The open-close cam 25 of the open-close mechanism 18 and the take-down force adjusting cam 40 are mounted on the same cam shaft 86 to be rotated together.

This combination of the cams 25, 40 allows the casings 22, 22 to be switched to two modes of "open" and "close" and allows the take-down force of the take-down member 47 to be adjusted in four steps of "Strong", "Medium", "Weak" and "Rest" by the take-down force adjusting mechanism 20 when the casings 22, 22 are in the "close" mode.

Next, description on the switch to the open and close modes of the casings 22, 22 and the four-steps adjustment of the take-down force of the take-down members 47 will be given below. It is noted here that the take-down amount of the knitting fabric capturing surface forming member 53 is defined using the distance (S in FIG. 18) by which the knitting fabric capturing surface forming members 53 are raised by the cam contours of the raising cams 71 via the raising levers 73 as a basic stroke.

The open mode of the casings 22, which is the state in which the knitting fabric passageway 8 for the knitting fabric to pass along opens between the front and back casings 22, 22 incorporating the knitting fabric capturing surfaces 19 therein, is provided by the following operations of the open-close mechanism 18.

First, the motor 84 to be controllably rotated by a controlling unit (not shown) for controlling the knitting of the flat knitting machine 1 allows the cam shaft 86 to be rotated via the gear transmission mechanism 85 and the open-close cam 25, when the open-close swinging bracket 27 is swung in a counterclockwise direction as viewed in FIG. 3. The swinging motion of the swinging bracket 27 drives the front open-close arm 29 of the front casing 22 to be rotated in a clockwise direction and the back open-close arm 33 of the back casing 22 to be rotated in a counterclockwise direction.

This causes the front and back casings 22, 22 to be moved away from each other by the parallel links 21, to provide the "open" mode as shown in FIGS. 2 and 3.

As a result of this, the knitting fabric passageway 8 opens widely between the front and back casings 22 by the parallel links 21, to achieve the state in which hook members 9 of the knitting-out device 5 can be raised up to the needle bed gap 4.

The take-down force adjusting cam 40 is then rotated together with the open-close cam 25, and thereby the take-down force adjusting bracket 42 is swung in the clockwise direction in the state shown in FIG. 6, so that the back operating shaft 79 is rotated in the counterclockwise direction via the interlocking lever 77.

The counterclockwise rotation of the operating shaft 79 causes the swinging shaft 82 to push a front part of the fork end 76*c* of the raising lever 76, as shown in FIG. 7, allowing the raising lever 76 to pivot on pivot shaft 72 in the clockwise direction. This causes the force application portion 76*b* of the raising lever 76 to push the push-up roller 56 to raise the knitting fabric capturing surface forming member 53 up to a position close to the upper limit.

The distance by which the knitting fabric capturing surface forming member 53 is raised via the force application portion 76*b* is set to be larger than the basic stroke S by which the knitting fabric capturing surface forming member 53 is raised by the raising cam 71 via the raising lever 73.

Because of this, the roller 65 at the back of the knitting fabric capturing surface forming member 53 at the center part thereof is retracted toward the holder 57 via the hook-like take-down part 66, so that the knitting fabric capturing surface 19 is retracted into the casing 22 against the coiled spring 63 (See FIG. 17-A).

In that state, when the solenoid 59 is energized, the engaging member 60 is tilted toward the engaging portion 61 to be brought into the state (Y) in FIG. 17-B from the state (X) in FIG. 17-B and is engaged with the lower engaging portion 61. As a result, the "retracted" state in which the knitting fabric capturing surface forming member 53 is held in proximity to the upper limit, with the knitting fabric capturing surface 19 retracted into the casing 22, is maintained.

It is noted here that the setting of the "retracted" state in which the knitting fabric capturing surfaces 19 are retracted into the casings 22 is made for part of the take-down members 47 lying outside the knitting width. Thus, the knitting of the knitting fabric is performed without a hitch, with the associated knitting fabric capturing surfaces 19 retracted into the casings 22. Further, when the knitting fabric is moved transversely for racking of the needle beds, the take-down members 47 lying in the passageway of the knitting fabric can be brought into the "retracted" state to ensure the passageway of the knitting fabric.

Next, when the front and back casings 22, 22 are switched to the "close" state, the motor 84 is rotated to rotate the open-close cam 25 fitted to the cam shaft 86 so that the front end portion of the open-close swinging bracket 27 can be swung in the clockwise direction from the state of FIG. 3.

Then, the front open-close arm 29 of the front casing 22 is rotated in the counterclockwise direction and the back open-close arm 33 of the back casing 22 is rotated in the clockwise direction. As a result of this, the front and back casings 22, 22 are pulled close to each other via the parallel links 21 to thereby produce the "close" state. With the engaging portion 61 disengaged from the engaging member 60 by interrupting the current to the solenoid 59, the knitting fabric capturing surface forming member 53 can be moved up and down to be selectively positioned between a position in which the knitting fabric can be taken down the knitting fabric capturing surfaces 19 and the "rest" position in which the knitting fabric is prevented from being moved up and down.

In the "rest" position in which the front and back casings 22, 22 are moved close to each other so that the take-down of the knitting fabric is not performed by the knitting fabric capturing surfaces 19 of the take-down members 47 which is in the "close" state, the solenoid 59 is energized to tilt the engaging member 60 toward the engaging portion 61 to be brought into the state (X) in FIG. 17-B from the state (Y) in FIG. 17-B and is engaged with the upper engaging portion 61. Then, the take-down member 47 is in a position slightly above the basic stroke S or the push-up roller 56 of the take-down member 47 is in a position slightly below the rotation passage of the cam contours of raising cams 71.

Hence, even when the raising cams 71 are rotated, the take-down members 47 are not raised by the cam contours of the raising cams 71, so the knitting fabric capturing surface forming member 53 are kept in rest. This setting of the rest position is made for the take-down members which lie within the knitting width but are not used in knitting in, for example, a pattern knitting.

Next, the description on the "strong" mode of the take-down force from the knitting fabric capturing surfaces 19 which are in the "close" state in which the front and back casings 22, 22 are pulled close to each other is given below.

When the take-down force is rendered "strong", the take-down force adjusting cam 40 is rotated to swing the take-down force adjusting bracket 42 so that the foremost end of the bracket 42 can be moved to the leftmost position, as viewed in FIG. 6, to rotate the operating shaft 79 via the connecting rod 45, the back arm 44 and the interlocking lever 77.

The rotation of the operating shaft 79 causes the front raising lever 76 to be rotated in the clockwise direction by the swinging shaft 82 at the operating lever 78 and causes the back raising lever 76 to be rotated in the counterclockwise direction, to lower the force application portions 76*b* of the raising levers 76, as shown in FIG. 18-A. As a result of this, the take-down tensile force adjusting spring 54 is stretched and the tensile force of the take-down tensile force adjusting spring 54 applied to the spring holder holding projection 55 is increased.

The take-down force required for take-down the knitting fabric with the knitting fabric capturing surfaces 19 is rendered "strong" by the increased tensile force of the take-down tensile force adjusting spring 54 and the take-down members 47 of their own weights.

The "strong" take-down force can be suitably used when a particularly strong take-down force is required for, for example, knitting only a part of the knitting width repeatedly. In that time, other parts not to be knitted are set to be in the "rest" state.

In the "strong" mode in which the tensile force of the take-down tensile force adjusting spring 54 is active, the tensile force can be adjusted in a stepless manner within the range of the tensile force of the take-down tensile force adjusting spring 54, to adjust the take-down force required for the knitting fabric to be taken down by the knitting fabric capturing surfaces 19.

When the take-down force, which is applied from the knitting fabric capturing surfaces 19 which are in the "close" state in which the front and back casings 22, 22 are pulled close to each other, is rendered "medium", the take-down force adjusting cam 40 is rotated to swing the take-down force adjusting bracket 42 so that the foremost end of the bracket 42 can be swung to a position to the right side from the "strong" position of FIG. 18 but to the left side from the position of FIG. 6.

This causes the front operating shaft 79 to be rotated from the "strong" position of FIG. 18-A in the clockwise direction via the connecting rod 45, the back arm 44 and the interlocking lever 77 and the back operating shaft 79 to be rotated in the counterclockwise direction.

The rotation of the operating shafts 79 causes the front swinging shaft 82 to be rotated in the clockwise direction and the back swinging shaft 82 to be rotated in the counterclockwise direction. This causes the stretched, take-down tensile force adjusting springs 54 to be contracted, to raise the force application portions 76*b* of a raising levers 76. As a result of this, the tensile force of the take-down tensile force adjusting springs 54 no longer acts on the take-down members 47.

As a result, the take-down of force required for take-down the knitting fabric with the knitting fabric capturing surfaces 19 is rendered "medium" in which the knitting fabric is taken down by the take-down members' own weights. In the "medium" mode, the general knitting is performed.

Further, when the take-down force applied from the knitting fabric capturing surfaces 19 which are in the "close" state in which the front and back casings 22, 22 are pulled close to each other is rendered "weak", the front operating shaft 79 is further rotated from the "medium" position in the clockwise direction and the back operating shaft 79 to be rotated in the counterclockwise direction. The rotation of the operating shafts 79 causes the front raising levers 73 to be rotated in the clockwise direction by the swinging shaft 82 via the helical spring 75 and the back push-up levers 73 to be rotated in the counterclockwise direction. This brings the helical springs 75 at the base ends 73*a* into a state of their being pressed by the swinging shaft 82 even after the foremost ends 73*b* of the raising levers 73 abut against the push-up rollers 56 of the take-down members 47, as shown in FIG. 19-A.

As a result, the take-down of force required for take-down the knitting fabric with the knitting fabric capturing surfaces 19 is reduced to a weight got by subtracting a weight equivalent of the pressure applied from the foremost ends 73*b* of the helical springs 75 from the take-down members' own weights, and thus is rendered "weak". The setting of the "weak" mode may be made for, for example, a welt seam treatment including a knitting fabric edge treatment.

The setting of the "strong", "medium", "weak" and "rest" modes of the take-down force for take-down the knitting fabric with the knitting fabric capturing surfaces 19 or the "retracted" mode of the knitting fabric capturing surfaces 19 being retracted can be made during the knitting of the knitting fabric. For example, when the take-down force for take-down the knitting fabric in a desired part of the take-down members 47 is switched from the "medium" mode to the "retracted" mode of the knitting fabric capturing surfaces 19, the front and back casings 22 are switched from "Close" to "Open" to bring the knitting fabric capturing surfaces 19 into the "retracted" mode. Then, after the "retracted" mode in which the desired part of the take-down members 47 are raised is maintained via the engaging members 60 of the solenoids 59, the front and back casings 22 are returned from "Open" to "Close". As a result of this, the take-down of force for take-down the knitting fabric in the part of the take-down members 47 are switched from the "medium" mode to the "retracted" mode.

It is preferable for a take-down device with take-down roller devices 6 like that of the present invention to hold and maintain the knitting fabric by the take-down roller devices 6 when the take-down force for take-down of the knitting fabric is switched from the "medium" mode to the "retracted" mode of the knitting fabric capturing surfaces 19.

With the take-down device 7 of the present invention, since the pairs of take-down means are arranged in front and back of the knitting fabric passageway 8, the take-down means for taking down the front and back knitting fabric parts forming a tubular knitting fabric can be individually controlled to take down each of the knitting fabric parts. This can provide the result that for example when a sweater whose front body and back body are different in shape and in the number of courses from each other is knitted, the knitting fabric is taken down.

In the above-mentioned embodiment, the open-close mechanism 18 is used to bring the take-down means 16, 17 into "open" positions in which the knitting fabric capturing surfaces 19 of the take-down means 16, 17 open widely, so as to provide passageways for allowing even two knitting-out devices to move up and down. The open-close mechanism 18 may however be omitted when only a single knitting-out device is provided or when no knitting-out device is provided.

The knitting fabric take-down device of the above-mentioned embodiment can, of course, be used not only for knitting a tubular knitting fabric having a double wall in section but also for knitting the front part or back part one by one as a separate knitting fabric (a single wall). However, in the case of a flat knitting machine designed mainly for knitting a front or back knitting fabric one by one without knitting the fabric into the tubular form, the knitting fabric take-down device may be modified such that the take-down means are provided at any one side of the knitting fabric passageway, while guide members, facing the knitting fabric pressing surfaces of the take-down members, for covering the stroke of the knitting fabric pressing surfaces to be moved up and down, are provided at the other side. In this modification, the guide members operate to prevent the knitting fabric from escaping from the knitting fabric capturing surfaces to surely capture the knitting fabric by the knitting fabric capturing surfaces.

Further, in the above-mentioned embodiment, every five of the take-down members are formed as a unit and the cam contours are shifted in phase from each other so that the take-down members can be pushed up in order from end to end, but the present invention may be embodied in several forms without departing from the sprit of essential characteristics thereof: for example, the number of take-down members used may be changed properly, or the fitting positions of the cam contours to the drive shaft may be changed so that the individual take-down members can be actuated with different timing (e.g. randomly).

(Second Embodiment)

Figure 20:
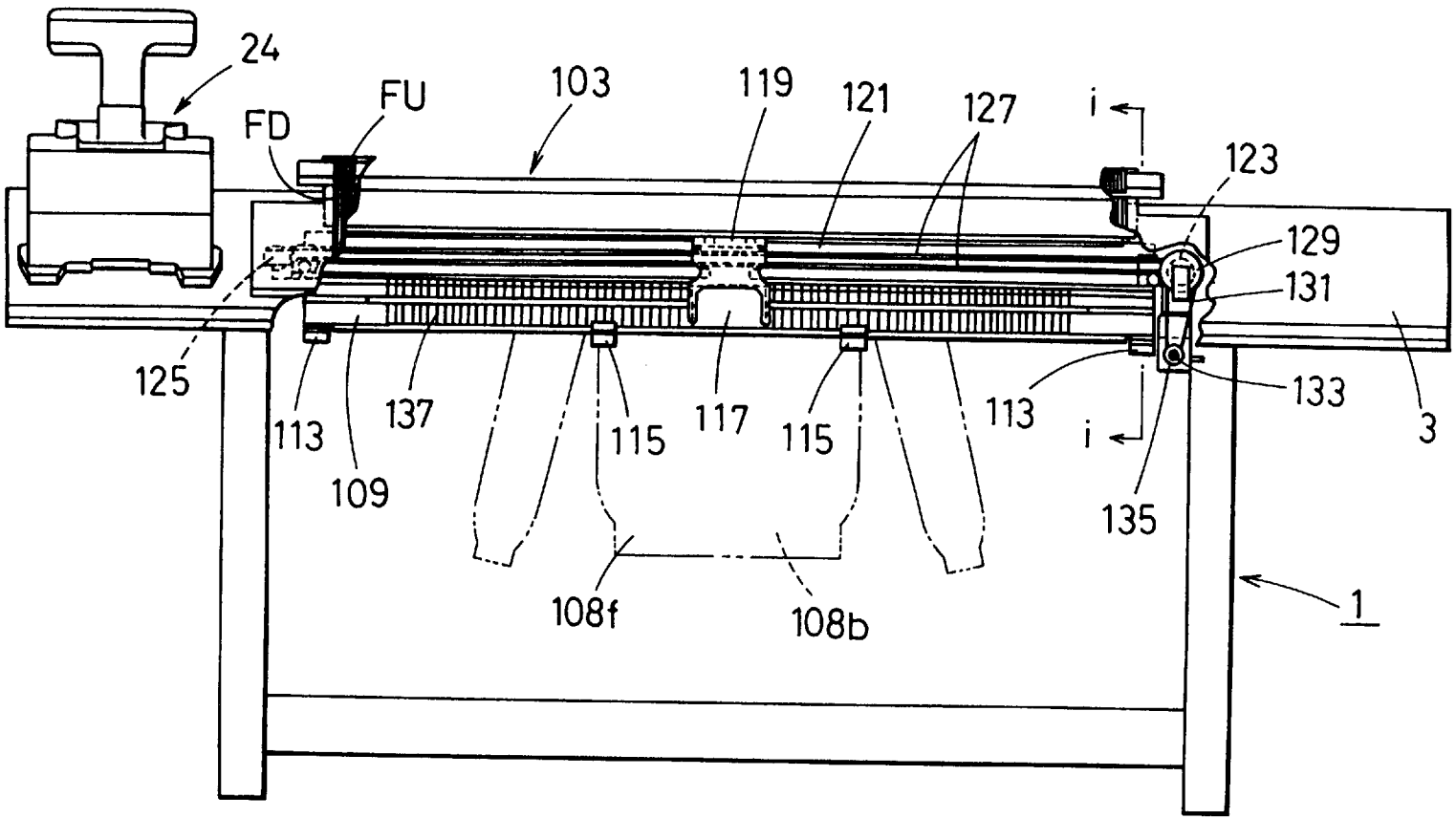
FIG. 20 is a partially perspective view of a flat knitting machine fitting thereto a knitting fabric take-down device of the second embodiment as viewed from the front.
Figure 21:
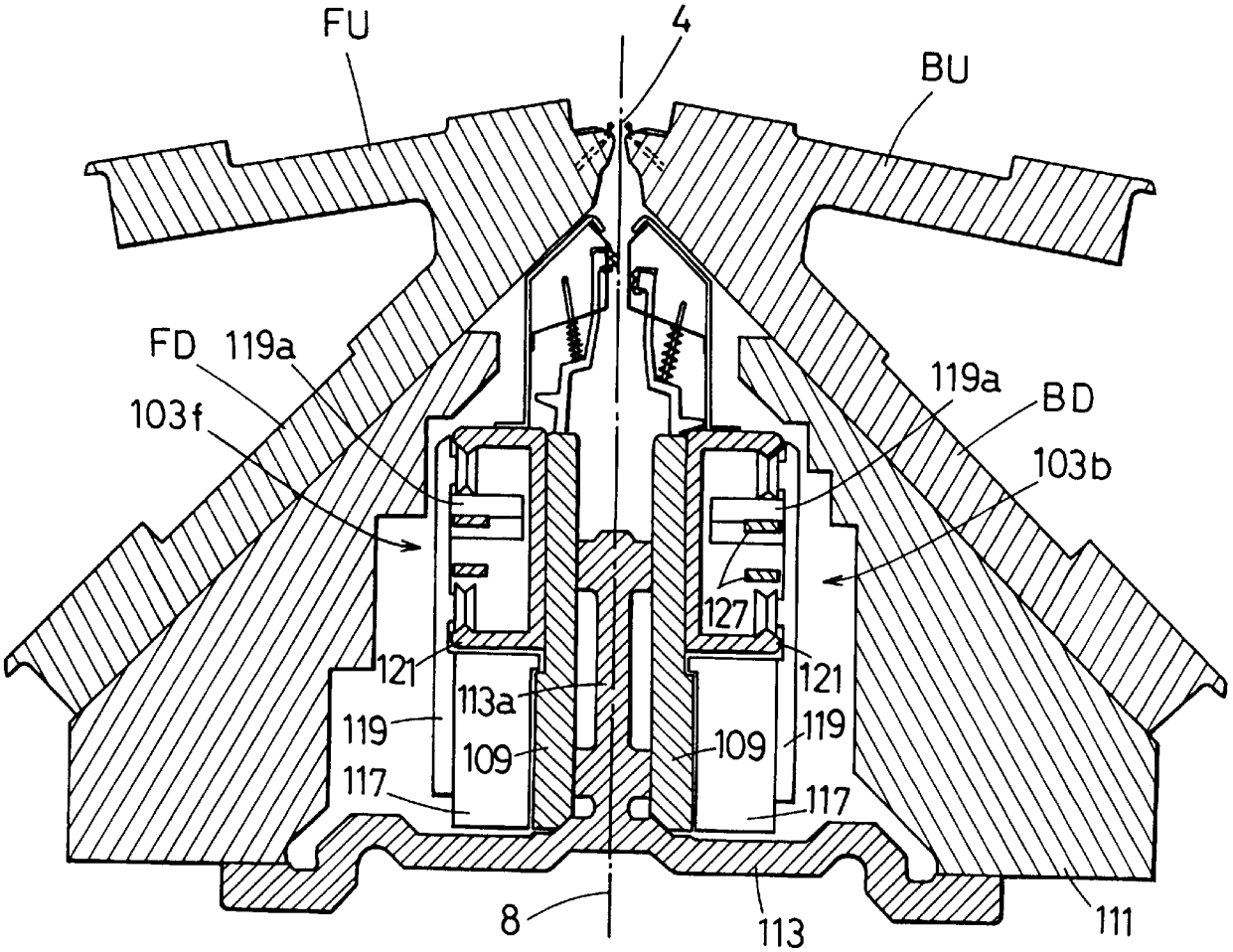
FIG. 21 is a sectional view of the same taken in the direction of the arrows on line i—i in FIG. 20.

FIG. 20 is a front view of a knitting fabric take-down device 103 set to the flat knitting machine 1 as illustrated partially in perspective; and FIG. 21 is a sectional view of the same taken in the direction of the arrows on line i—i in FIG. 20.

The knitting fabric take-down device 103 is composed of a front knitting fabric take-down portion and a back knitting fabric take-down portion 103*b*. The front and back knitting fabric take-down portions 103*f*, 103*b* are located under front needle beds (FD, FU) and back needle beds (BU, BD) of a flat knitting machine, with confronting each other across a passageway 8 as indicated by a chain line extending downwards of a needle bed gap 5 between the front and back needle beds.

In the exemplary embodiment of the invention as described below, hooks for hooking the knitting fabric such as take-down claws are used as the knitting fabric capturing means. The knitting fabric is hooked from the front surface side of the knitting fabric 108 and taken down by the hooks. There are provided take-down claw beds 109, each having a back surface in which a number of accommodation grooves 137 described later to accommodate the take-down claws are formed.

The beds 109 extend in parallel in a longitudinal direction of the needle beds and are threadedly fixed at the both ends thereof to a projecting portion 113*a* of an inverted T-like bracket 113 projecting from the bed (needle bed 3) 111 of the body to be supported on the flat knitting machine.

A reference numeral 115 in the drawing denotes a bracket, fixed to the bed 111 of the body at two points in a center part of the bed, for bracing the take-down claw beds 109.

It is noted that in the description, the side of the knitting fabric take-down portions facing the knitting fabric passage 8 is defined as the front side, and the side opposite thereto is defined as the back side. Since the front and back knitting fabric take-down portions 103*f*, 103*b* have the same structure, the description only on the back knitting fabric take-down portion 103*b* is given below. Parts of the front knitting fabric take-down portions 103*f* corresponding to those of the back knitting fabric take-down portion 103*b* are given the same reference numerals.

A knitting fabric take-down cam carriage 117 controls forward and backward movements of the take-down claws fitted to the take-down claw beds 109. The carriage 117 is guided by the drive guide rails 121 fixed to the take-down claw beds 109 and is mounted on drive guides 119 movable along a longitudinal direction of the take-down claw beds.

The drive guides 119 are fixed at one ends 119*a* thereof to timing belts 127 stretched between pulleys 123, 125 provided at both ends of the take-down claw beds 109 via proper means. Rotational drive of a drive motor 135 is transmitted to the pulley 123 via a pulley 133 supported by a rotation axis of the motor 135, a timing belt 131 and a pulley 129, with the result that the cam carriage 117 is moved over the take-down claw beds.

The normal and reverse rotation of the drive motor 135 drives the cam carriage 117 to move to and fro along the longitudinal direction of the take-down claw beds 109.

(Bed Arrangement)

Figure 23:
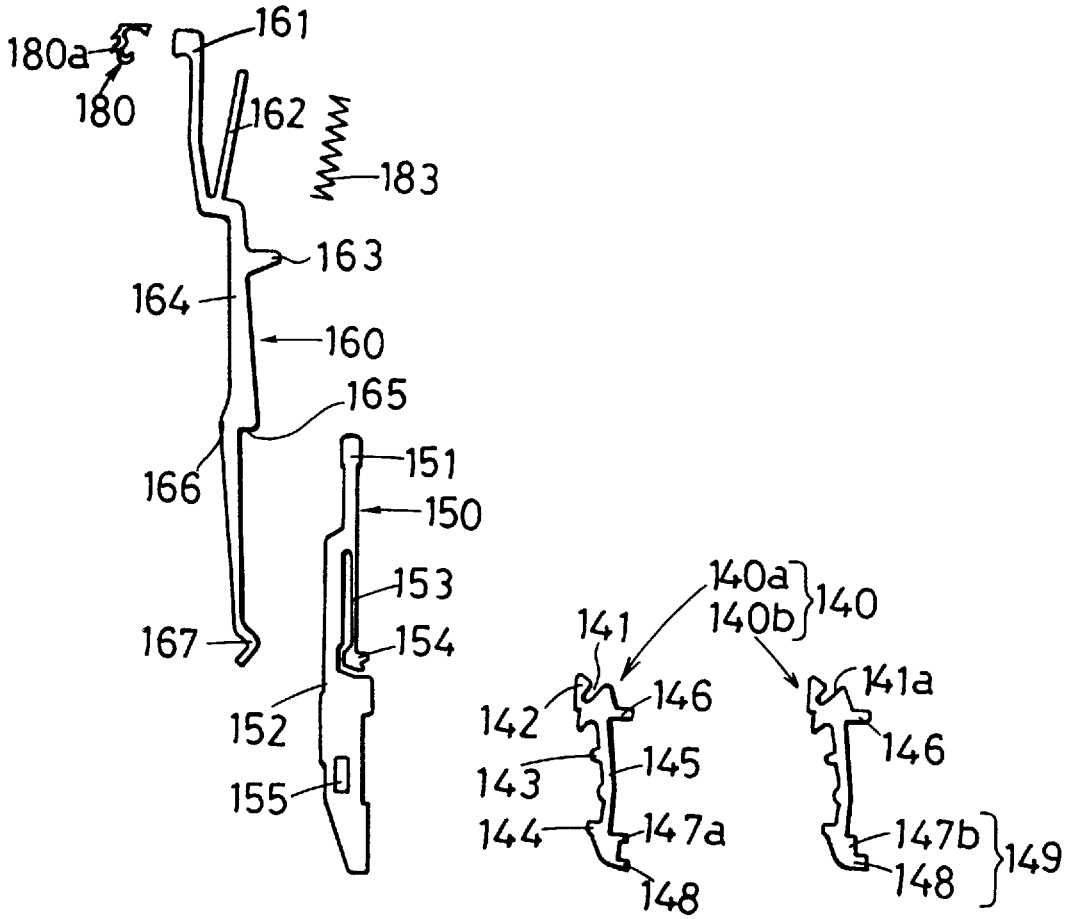
FIG. 23 is a side view of the components to be fitted to the take-down claw bed.
Figure 24:
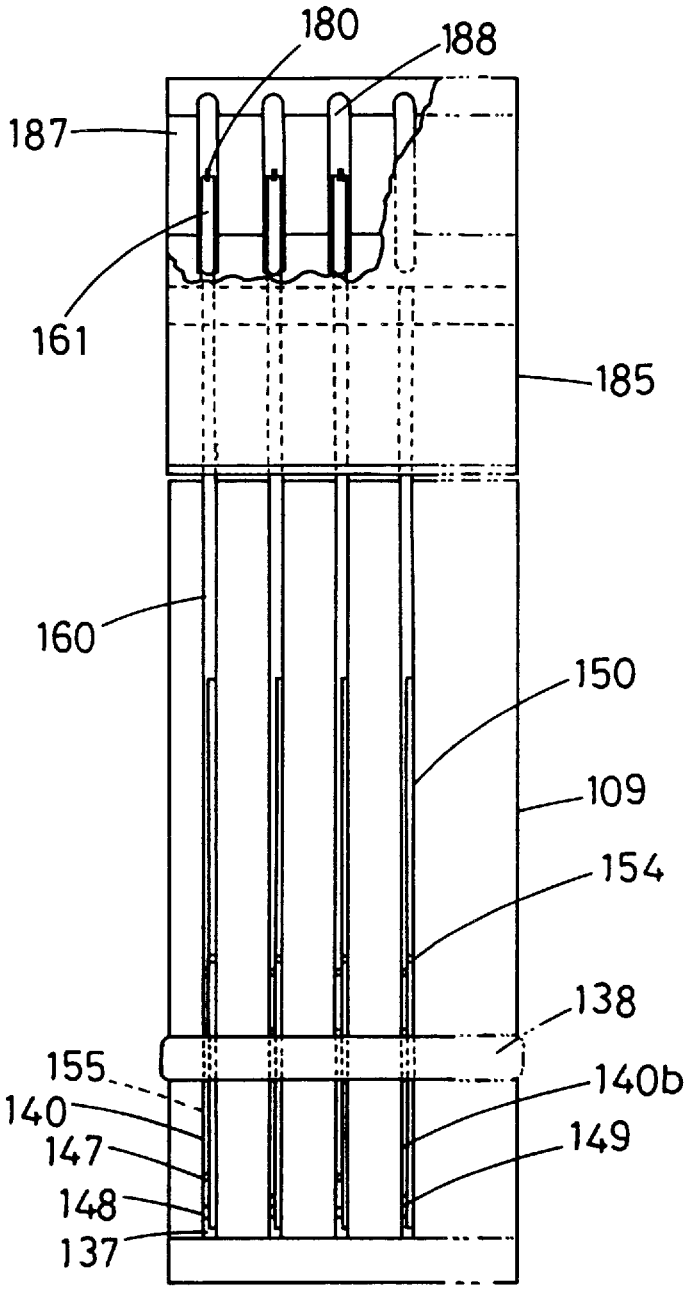
FIG. 24 is an illustration of a part of the take-down claw bed as viewed from the back.

FIGS. 22–24 show the structure of the knitting fabric take-down portion. FIG. 22 illustrates a lowered (retracted) position of a take-down claw for capturing the knitting fabric (FIG. 22-A) and a raised (projected) position thereof (FIG. 22-B). FIG. 23 shows components to be fitted to the take-down claw bed 109.

FIG. 24 shows the knitting fabric take-down portion as viewed from the rear side, with the drive guides 119 removed therefrom and a part of a claw guide plate 187 drawn in perspective.

The take-down claw bed 109 has a number of accommodation grooves 137 in which selectors 140, claw jacks 150 and take-down claws 160 are fitted. Each accommodation groove 137 is composed of a shallow groove portion 137*a* and a deep groove portion 137*b*. An upper portion of the claw bed 109 for accommodating the take-down claw 160 is formed as the shallow groove portion 137*a*, and a lower portion of the claw bed 109 for accommodating the selector 140 is formed as the deep groove portion 137*b*.

Each claw jack 150 is provided, at its foremost end, with a push-up arm 151 which is brought into abutment with a step portion 165 of the take-down claw 160 when moved forward; at a rear position of the push-up arm 151 with a branched arm 153 branching from a body 152 of the claw jack 150; and on a back surface at the foremost end of the branched arm 153, with a butt 154.

The butt 154 is hidden inside of the deep groove portion 137*b* when the claw jack 150 is in a position backed in the accommodating groove and is exposed outside of the shallow groove portion 137*a* when the claw jack 150 is in a position forwarded in the accommodating groove. The claw jack 150 and the selector 140 are arranged in a layered manner in the accommodation groove. The claw jack 150 is provided, at its slidably contacting surface side with the selector 140, with a differential portion 155 formed to be projected into an accommodating surface of the selector 140.

The selectors 140 include two types of selectors, i.e., a first selector 140*a* and a second selector 140*b*. The first selector and the second selector are identical in shape, but difference in the location for a butt 147 to be formed on the back surface of the selector at a tail portion.

The first selectors 140*a* are accommodated in the odd accommodating grooves from the left end of the claw bed 109 and the second selectors 140*b* are accommodated in the even accommodating grooves from the same. The first selectors 140*a* are selected when the knitting fabric take-down cam carriage 117 is being moved to the left side, and the second selectors 140*b* are selected when the cam carriage 117 is being moved to the right side.

Each of the selectors 140 is provided, at a foremost end thereof, with a receiving portion 141 into which a generally L-shaped lower end 167 of a take-down claw 160 described later and a locking claw 142 engageable with an engaging portion 173 of a locking groove 171 shaped in the take-down claw bed 109 at the front thereof.

Also, the each selector 140 is provided, at a front center part thereof, with a pair of spaced apart, upper and lower stoppers 143, 144 projecting from the selector and a swinging fulcrum 145 between the stoppers 143, 144.

Further, the selector 140 forms on the back surface thereof a first butt 146, a second butt 147 and a third butt 148 which are vertically arranged from the top and are adapted to be able to project out of the accommodating groove. The second selector 140*b* is provided with butts 147, 148 which are continuously formed in a wide butt 149. Operations of the butts will be described later.

The differential portion 155 of the claw jack 150 is located between the stoppers 143, 144 of the selector 140 and allows an elevating action of the claw jack 150 to be later than that of the selector 140 by an amount corresponding to one differential when the selector 140 is moved forward and backward via a cam means mounted on the knitting fabric take-down carriage 117 as described later.

Each of the take-down claws 160 has at its foremost end a claw fitting portion 161 with a fitting groove (not shown), into which a body of a claw 180 formed separately from the take-down claw is fitted. The claw 180 is formed by a thin sheet of plate so that a tip 180*a* of the claw it can penetrate a knitted loop to capture the knitting fabric.

The claw fitting portion 161 has, on the back side at a rear portion thereof, a spring insertion portion 162 and a lower limit stopper 163. The body 164 of the take-down claw has, on the back side at the center portion thereof, a step 165 to abut with the push-up arm 151 of the claw jack 150 and has, at the front thereof, a fulcrum 166 to abut with a bottom wall of the accommodating groove. A coiled spring 183 is fitted to each of the spring insertion portion 162. A lower end portion 167 of the take-down claw 160 is formed into a generally L-like shape so that it can be fitted into the receiving portion 141 of the selector. The reference numeral 138 designates a pressure plate for keeping the selector 140 and the claw jack 150 from falling out of the accommodating groove 137 of the claw bed 109.

At a foremost end portion of the take-down claw 160 are provided a plate 185 mounted on an upper edge of the drive guide rails 121 and the claw guide plate 187 fixed to the plate 185 and forming therein a number of slits 188 for guiding and accommodating the take-down claws 160.

An interval between the claw guide plates 187 of the front and back knitting fabric take-down portions 103*f*, 103*b* is set to be around 10 mm so that when the claws 180 are exposed from the associated slits 188 in the front and back take-down claw beds to capture the knitting fabric, they cannot interfere with each other.

The stroke of each reciprocating take-down claw 160 is set to be around 10 mm, which may be increased. The number of take-down claws are not necessarily the same as the number of needles on the needle beds. The take-down claws may be arranged at intervals of, for example, 2–10 needles, in other words, one needle per 2–10 wale.

(Cam Carriage)

FIG. 25-A shows a perspective view of a cam arrangement of the cam carriage 117 for take-down a knitting fabric; and FIG. 25-B shows a sectional view of the same taken in the direction of the arrows on line ii—ii in FIG. 25-A. The cam plate 190 is provided, at a center part thereof, with a selector raising cam 191 and a selector lowering cam 192. The selector raising cam 191 is composed of an upper raising cam 191*a* engageable with the first butts 146 of the selector and a lower raising cam 191*b* engageable with the third butts 148 of the selector.

The lower raising cam 191*b* is provided at the top with a presser cam 193 for releasing the rest of claw and is provided, at both sides thereof at the foot, with selector selection portions 100R, 100L.

Each of the selector selection portions 100R, 100L is provided with a movable presser cam 101, 103 and a fixed presser cam 102, 104.

The upper raising cam 191*a* is provided at the top with a presser cam 194 for resting the claw thereon, and a pair of right and left claw jack holding cams 195, 196 are provided along an upper edge of the selector lowering cam 192. Reference numerals 197, 198 designate reset cams provided at both ends of the cam plate.

Among the above-mentioned cams, the movable cams which are selectively actuated between an active position and an inactive position by an actuator such as a solenoid are the presser cam 193 for releasing the rest of claw; the movable presser cams 101, 103 provided at selector selection portions 100, respectively; and the presser cam 194 for resting the claw thereon.

Each of the claw jack holding cams 195, 196 is formed as a swinging type presser, but no specific actuator is provided for actuating the claw jack holding cams themselves. The claw jack holding cams are so designed as to be swung upwards with respect to a position shown in the views and be returned to the reference position by a biasing means (not shown) when no load is applied.

A grooved cam 107 for the first butt 146 of the selector formed between the upper raising cam 191*a* of the selector and the selector lowering cam 192 is in a higher level than the cam plate 190. A reference numeral 109 denotes cam inclination.

The cam carriage 117 is moved in reciprocation over the take-down claw beds 109, and the reset cam 197 or 198 pushes the first butt 146 before the selector selection portions 100 reach the selector 140, whereby the selector 140 is swung around a fulcrum 145 on the differential portion 155 of the claw jack 150.

As a result, the second and third butts 147, 148 at the tail portion of the selector are exposed from the accommodating groove to be returned to their selectable projecting positions (reset positions) at the selection portions 100.

The selector selection portion 100R, which is one of the selector selection portions 100 located right and left, works when the carriage is moved to the right, and the other selector selection portion 100L works when the carriage is moved to the left. The selector selection portion 100R has the fixed presser cam 102 disposed at a lower part thereof and the movable (swingable or retractable) presser cam 101 disposed at an upper part thereof.

Figure 27:
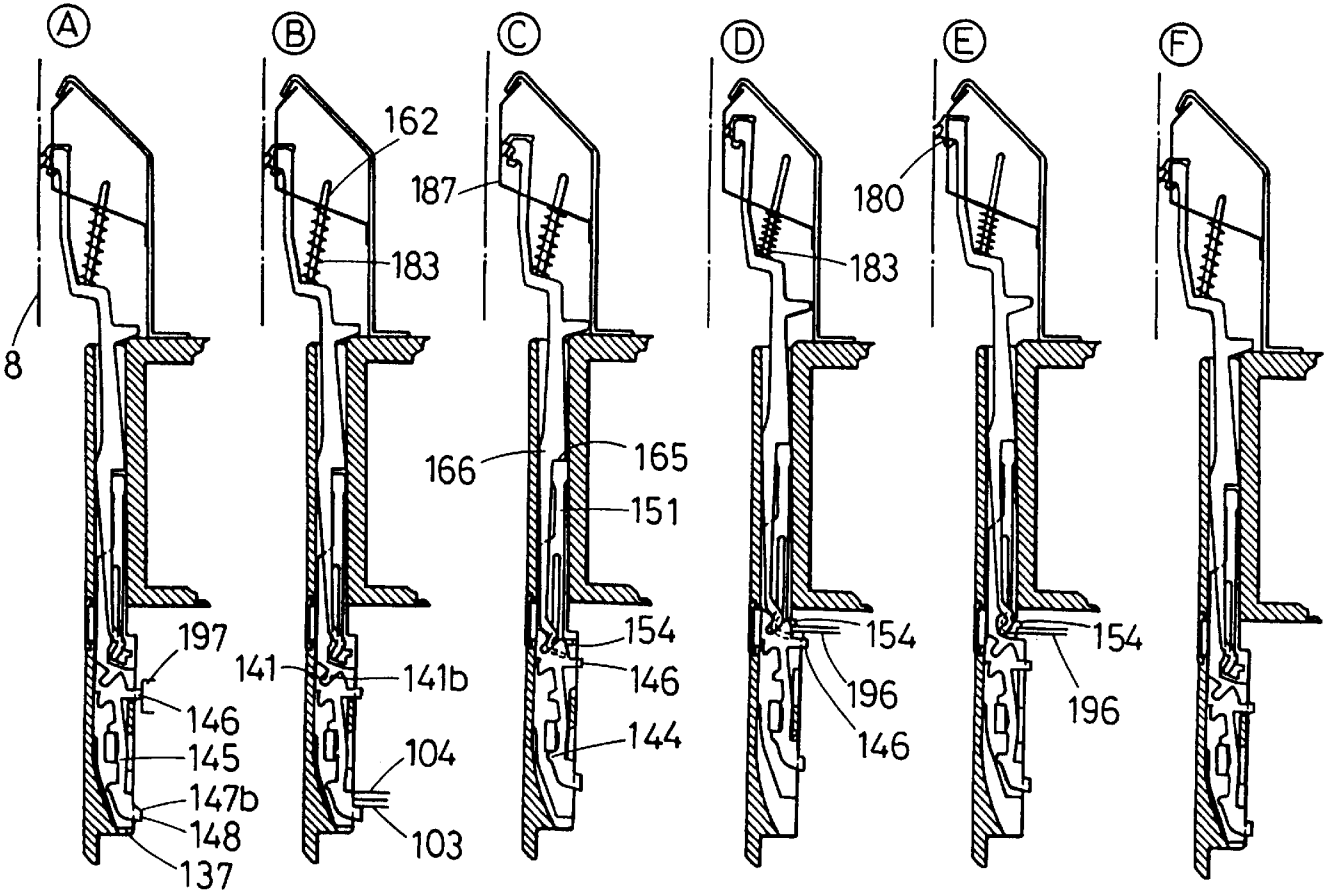
FIG. 27 is an illustration of the forward and backward motion of the take-down claw of the cam carriage in phases A to F of FIG. 26.

The fixed presser cam 102 presses the butt 147*b* of the second selector 140*b* which is in the reset position shown in FIG. 27-A, to sink it in the accommodating groove at a position at which the second selector is acted on by the lower raising cam 191*b*.

The movable presser cam 101 works to the second butt 147*a* of any selected first selector 140*a* which is in the reset position, so that only the selectors which were not acted on by the movable presser cam 101 are brought into engagement with the next lower raising cam 191*b*.

Similarly, the selector selection portion 100L has the fixed presser cam 104 disposed at an upper part thereof and the movable presser cam 103 disposed at a lower part thereof. The fixed presser cam 104 presses the butt of the first selector 140*a* which is in the reset position, to sink it in the accommodating groove. The movable presser cam 103 works to the second butt 147*b* of the second selector 140*b* which is in the reset position, so that the selectors pressed by the movable presser cam 103 are not acted on by the next raising cam 191. As a result, only the selectors which were not acted on by the movable presser cam 103 are brought into engagement with the next selector raising cam 191.

The cam carriage 117 for take-down of the knitting fabric is controlled to be driven in association with the knitting action of a knitting carriage 114. For example, when a knitted loop course for the front body side is formed, the cam carriage 117 of the front knitting fabric take-down portion 103*f* is driven to allow the take-down claws corresponding thereto to work to take down the front body of the knitting fabric.

An example is given below, taking the case where a body of the knitting fabric is knitted round into a tubular form by feeding a knitting yarn in the counterclockwise direction so that the knitting yarn is fed from the right to the left for a front body 108*f* and from the right to the left for a back body 108*b*. When the course formation for the front body 108*f* is completed, the cam carriage 117 of the front knitting fabric take-down portion 103*f* is moved to the right to allow the even take-down claws 160 to work and thereafter is reversed to be moved to the left to allow the uneven take-down claws to work, whereby the knitting fabric is taken down.

When the course formation for the back body 108*b* is completed, the same operations as in the front knitting fabric take-down portion 103*f* are performed in the back knitting fabric take-down portion 103*b*.

Thus, every time the course formation for each of the front body 108*f* and back body 108*b* is completed, the associated take-down claws 160 are allowed to take down the knitting fabric. As mentioned above, since the take-down of the knitting fabric is performed by actuating the associated, even take-down claws and the associated, odd take-down claws fitted in the claw beds 109 alternately and successively at a time interval, the both claws can be prevented from being released from the knitting fabric simultaneously to avoid a risk of the knitting fabric being raised accidentally.

When more course formation is attempted to be given to a specific part of the front body side than to the rest of it, the number of times the take-down claws associated with that part are actuated is increased over the number of times of the take-down claws associated with the rest are actuated, before the take-down of the knitting fabric.

(Pattern 1) Take-down Action of the Second Selector

FIGS. 26–28 show the forward and backward movement of a take-down claw 160 in each phase or position A–F of the cam carriage 117 for puling the knitting fabric when the cam carriage 117 is moved to the left side. In this case, the second selectors 140*b* accommodated in the even accommodating grooves are selected in the selector selection portion 100L to control the forward and backward movement.

(Position A)

At the illustrated position A of FIG. 26, the first butt 146 is pressed by the action of the reset cam 197 and thereby the selector 140*b* is swung around the fulcrum 145 to allow the butt 149 (147*b*, 148) to project out of the accommodating groove 137*b*.

(Position B)

Next, at the position B illustrating the state of the selector 140*b* reaching the selector selection portion 100L, the movable presser 103 is swung and shifted to a position at which the movable presser 103 does not press the butt 147*b*, so that the butts 147*b*, 148 are kept in the position of their projecting out of the groove.

The swinging motion of the movable presser cam 103 is controlled on a selector-by-selector basis. Only the selected second selectors 140*b* are kept in their butts 147*b*, 148 being in the positions projected from the grooves, while the non-selected second selectors 140*b* are pressed by the movable presser cam 103 to be sunk in the grooves.

At that time, the first selectors 140*a* are all acted on by the fixed presser cam 104, so that the butts 147*a* are sunk in the grooves.

(Position C)

The illustrated position C shows the state in which the second selector which was selected and remained in the grooves at the position B is engaged with the lower raising cam 191*b* at the butts 147*b* and is raised up to a mid point of the cam inclination.

At this position, the lower end 167 of the take-down claw 160 is fitted into the receiving portion 141 of the selector and also the lower stopper 144 of the selector 140*b* is brought into contact with the differential portion 155, thereby starting the claw jack 150 being raised up.

As a result, the push-up arm 151 is brought into abutment with step portion 165 of the take-down claw 160 to raise the take-down claw 160. As the selector 140*b* is increasingly raised, the lower end 167 of the take-down claw 160 is guided into the receiving portions by an inclined surfaces 141*a* of the receiving portions 141 to be fitted therein deeply.

During the fitting, the take-down claw 160 is swung in the clockwise direction around the fulcrum 166 located at the center part thereof and shifted in position.

As a result of this, the foremost end of the take-down claw 160 releases the knitting fabric 108 on the knitting fabric passageway 8 from the engagement and is sunk in the slit 188 of the claw guide plate 187. The upward movement of the selector 140 at the initial stage is caused by the engagement of the butt 148 with the lower raising cam 191*b*, and the first butt 146 is raised up to such a position as to be engageable with the upper raising cam 191*a*. The sequential upward movement of the selector 140 is caused by the upper raising cam 191*a*.

(Between Positions C and D)

Between the positions C and D, the selector 140 is moved up further by the action of the upper raising cam 191*a*, and with this further upward movement of the selector 140, the claw jack 150 and the take-down claw 160 are raised together.

As a result of this, when the first butt 146 of the selector reaches the top of the upper raising cam 191*a*, the butt 154 of the claw jack comes to be guided up to the position beyond the claw jack holding cam 195 (Position D). During this movement, the coiled spring 183 are compressed and deformed.

(Position E)

At the position E, the first butt 146 of the selector are lowered by the action of the selector lowering cam 192, but the claw jack holding cam 196 hinders the butt 154 of the claw jack 150 from being lowered, due to which the fittings of the lower end 167 of the take-down claw 160 in the receiving portion 141 of the selector is released. As a result of this, the take-down claw 160 is swung in the counter-clockwise direction, so that the claw 180 is projected out from the slit 188 of the claw guide plate 187 to capture the knitting fabric on the knitting fabric passageway 8.

(Positions E–F)

The illustrated position F shows the state in which the selector 140 and the claw jack 150 are lowered and returned to the original initial positions. After the claw 180 captures the knitting fabric at the position E, the take-down claw 160 allows the knitting fabric to be taken down by the resilient force of the coiled spring 183 fitted onto the spring insertion portion 162.

The alphabets S, T, U shown in FIG. 26 represent the forward and backward movement paths of the butts 146, 147 of the selector and the butt 154 of the claw jack.

(Pattern 2) Rest of the Take-down Action of the Second Selector

Next, reference to the case where the claws 180 of the take-down claws 160 are stopped temporarily in the slits 188 of the claw guide plates 187 to suspend the take-down of the knitting fabric temporarily will be given below.

The take-down claws 160 will be brought to rest if for example the knitting fabric to be taken down should not be in the knitting fabric passageway 8. Take the front body for instance, the knitting of a V neck opening is the case.

In this case, the selectors are operated in the same manner as in the above in the positions A to C, while, in the position C' as shown in FIG. 28-B, the first butt 146 of the selector 140*b* is sunk in the accommodation groove under the action of the presser cam 194 for resting the claw thereon.

At that time, the locking claws 142 of the selectors are fitted in the engaging portions 173 of the locking grooves 171 in the claw beds 109, so that the claws 180 of the take-down claws 160 are maintained in their swung positions hidden in the slits 188 without acting on the knitted fabric. The fitting of the selectors 140*b* in the locking grooves 171 are kept even after the selectors pass through the claw-resting-use presser cam 194, so that the first butts 146 of the selectors are maintained in their sunk positions in the accommodating grooves without being acted on by the next coming selector lowering cam 192.

Thus, the selector 140, the claw jack 150 and the take-down claw 160 are maintained in the state shown in FIG. 28-B even after the cam carriage 117 has passed.

(Pattern 3) Release from the Rest of Take-down Action of the Second Selector

Next, reference to the case where the take-down claws 160 once rested temporarily as described above are released from the rest, to capture the knitting fabric 108 will be given below. This releasing action is performed when the cam carriage 117 is moved to the left, as is the case with the above. When the butt 148 of the each selector 140*b* rested in an earlier course formation reaches the illustrated position C", the rest-releasing-use presser cam 193 come to act on the butt 148 to allow the selector 140*b* to be swung and shifted in the clockwise direction, as shown in FIG. 28-A.

This allows the engagement of the locking claw 142 of the each selector with the engaging portion 173 of the locking groove 171 to be released so that the first butt 146 of the selector is exposed outside of the accommodating groove. As a result of this, the first butt 146 of the selector is lowered under the action of the next selector lowering cam 192. The operations after the position C" are made in the same manner as those in the above-mentioned positions D, E and F. At the position E, the knitting fabric is captured and taken down with the claws 180 of the take-down claws 160.

While the operations of the take-down claws of the second selectors 140*b* are simply described above, the operations of the take-down claws of the first selectors 140*a* are made in the same manner as those of the second selectors 140*b*, except the difference in direction for the cam carriage 117 to be forwarded.

(Third Embodiment)

Next, a modification of the invention will be described below. In the modification, the knitting fabric capturing means is composed of a knitting fabric suction mechanism.

In the knitting fabric suction mechanism, an endless belt in which a plurality of suction holes are bored is stretched between rollers spaced apart from each other at an interval along the knitting fabric passageway. These components are supported in casings, each of which has an opening on its side facing the knitting fabric passageway and is connected with a vacuum source including a blower motor via a conduit to form a single vacuum unit.

One of the rollers disposed in the vacuum units is formed as a drive roller, for which an electric-motor-built-in type roller may be used.

A number of single units of these are arranged along a longitudinal direction of and under the needle beds, with confronting each other across the knitting fabric passageway. Each vacuum mechanism is controlled in association with the knitting operations of the knitting fabric, to take down the knitting fabric, as in the case with the above-described embodiments.

The above-mentioned embodiments, in which the claw formed of a thin sheet of plate forms the hook means for hooking the knitting fabric, may be modified such that instead of the claw, a brush-like member with a number of needles planted in lines may be used so that a plurality of knitted loops arranged in the directions of wales and courses is hooked with the needles.

Further, the above-described embodiments, in which the cam carriage which travels over the claw beds drives the take-down claws, may be modified such that a driving means such as a linear actuator is connected with the individual take-down claw separately, to control the drive of the driving means. Thus, the present invention may be embodied in several forms without departing from the sprit of essential characteristics thereof.

As apparent from the above, with the take-down device of the present invention, when the knitting fabric knitted into a double wall fabric having the front body and the rear body like a tubular knitting fabric is taken down, since the front knitting fabric take-down means and the back knitting fabric take-down means, which are arranged with confronting each other across the knitting fabric passageway, act individually on the front body side and the back body side of the knitting fabric, respectively, even a non-sewn knit requiring no need for the sewing process can be adequately taken down with a proper take-down force.

In particular, with the knitting fabric take-down device comprising the open-close mechanism for allowing the front side knitting fabric take-down means and the back side knitting fabric take-down means to be synchronized to move close to and away from each other; and the take-down force adjusting mechanism for adjusting the take-down force required for the knitting fabric capturing surfaces, the front and back side knitting fabric take-down means each being composed of a plurality of take-down members which are arranged in the longitudinal direction of the needle beds so that the individual take-down members can be sequentially or separately actuated to take down the knitting fabric, the take-down action (active or inactive) and take-down force of the knitting fabric capturing surfaces can be freely set at an optimum value by combination to suit the type of knitting fabrics. For instance, even when a hole is formed in the knitting fabric or the knitting fabric is moved transversely a lot by racking, the knitting action of the knitting fabric can be smoothly performed by allowing the take-down members associated to that part to be moved away from the knitting fabric and backed therefrom.

Further, since the knitting fabric take-down device of the present invention is so constructed that a number of knitting fabric capturing portions are arranged in the longitudinal direction of the needle beds and the individual knitting fabric capturing portions are controlled to be driven selectively or sequentially, the knitting fabric can be taken down with an optimum take-down force even when the front body and the back body to be knitted into a tubular body are not identical in shape and number of courses of loops, as in the case of a hole being formed in the knitted fabric.

Also, with the knitting fabric take-down device of the present invention, any selected knitting fabric capturing portions from a number of knitting fabric capturing portions, which are arranged in the longitudinal direction of the needle beds and are controlled to be selectively driven, can be released from the engagement with the knitting fabric as required, as mentioned above. Hence, even when a hole is formed in the knitting fabric or the knitting fabric is moved transversely a lot by racking, the knitting action of the knitting fabric can be smoothly performed by allowing the take-down members related in position to that part to be moved away from the knitting fabric and backed therefrom. In addition, the capture and release of the knitting fabric can be automatically performed by simply moving the knitting fabric capturing surfaces up and down in the same plane. Further, the knitting fabric capturing surfaces fitted to the take-down members via the elastic members can provide the advantage of facilitating the release of the knitting fabric from the knitting fabric capturing portions. Moreover, the force required for taking down the knitting fabric by the knitting fabric capturing surfaces can be set at any desired value in accordance with the types of knitting fabrics and the knitting conditions.

While the preferred form of the present invention has been described, it is to be understood that modifications will be apparent to those skilled in the art without departing from the sprit of the invention. The scope of the invention, therefore, is to be determined solely by the following claims.

What is claimed is:

1. Knitting fabric take-down devices for a flat knitting machine to take down a knitting fabric from the flat knitting machine, said flat knitting machine having at least a pair of front and back needle beds and a needle bed gap therebetween, said take-down devices being located in front of and back of and facing each other across a knitting fabric passageway formed under said needle bed gap, each of said knitting fabric take-down devices comprising:

front knitting fabric take-down means for capturing only a front part of the knitting fabric in the knitting fabric passageway and taking only the captured front part down;

individually operated back knitting fabric take-down means separate from said front knitting fabric take-down means for capturing only a back part of the knitting fabric and taking only the captured back part down; and a take-down force adjusting mechanism for each of said fabric take-down means for adjusting a take-down force of each of said knitting fabric take-down means, said front and back knitting fabric take-down means each comprising a plurality of take-down members arranged along a longitudinal direction of said needle beds and each being adapted to be actuated to take down the captured front part and the captured rear part of the knitting fabric.

2. Knitting fabric take-down devices for a flat knitting machine according to claim 1, including an open-close mechanism for controlling said front and said back knitting fabric take-down means to move the take down means from a first open position to a second close position away from and close to each other.

3. Knitting fabric take-down devices for a flat knitting machine according to claim 1, wherein each of said take-down members includes a part having a knitting fabric capturing surface which is formed into a shape capable of capturing the knitting fabric when lowered and releasing the knitting fabric when raised.

4. Knitting fabric take-down devices of a flat knitting machine according to claim 3, wherein said knitting fabric capturing surface of said knitting fabric take-down means is biased in a first position in a direction in an active mode projecting from said take-down member and in an inactive mode said capturing surface is retracted to a second position different from said first position to the position of the projection relative to said take-down member.

5. Knitting fabric take-down devices of a flat knitting machine according to claim 3, wherein said knitting fabric capturing surface is formed by a plurality of needles which are planted in a surface of a base and are bent to point obliquely downward.

6. Knitting fabric take-down devices of a flat knitting machine according to claim 3, wherein said knitting fabric capturing surface is fitted by an elastic member to said take-down members.

7. Knitting fabric take-down devices of a flat knitting machine according to claim 5, wherein said take-down members and said take-down force adjusting means are connected with each other via elastic members, and an elastic member connecting portion of each of said take-down force adjusting mechanism is changed in position to vary a resilient force of each of said elastic members, to render the knitting fabric take-down force of said knitting fabric capturing surfaces variable.

8. Knitting fabric take-down devices of a flat knitting machine according to claim 1, including a take-down actuation portion formed by take-down claws arranged in parallel with a lengthwise dimension of said needle beds;

means for taking down said take-down claws, said means for taking down including a take-down claw bed;

selectors, take-down claw jacks and said take-down claws being fitted in a number of accommodating grooves formed in said take-down claw bed;

biasing means for biasing said take-down claws downwards;

a carriage movable in reciprocation in a widthwise direction of said take-down claw bed;

selecting means, mounted on said carriage, for selecting any desired take-down claws from said take-down claws; and cam means, provided in said carriage, for raising said selected take-down claws by said selecting means.

9. Knitting fabric take-down devices of a flat knitting machine according to claim 8, wherein said take-down claws have end portions and are biased downwards and said selectors and said take-down claws are engaged with each other at their engaging portions to swing said claws in a direction of foremost end portions of said claws moving away from said knitting fabric, to allow said claws to be disengaged therefrom, and then after said take-down claws are raised while keeping their engagement with said selectors, said selectors are lowered to be released from their engagement with said take-down claws, to swing claws of said take-down claws toward said knitting fabric, to allow said claws to capture said knitting fabric.

10. Knitting fabric take-down devices of a flat knitting machine according to claim 3, wherein said knitting fabric capturing surfaces are each provided with suction means by which said knitting fabric is vacuumed.

11. Knitting fabric take-down devices for a flat knitting machine including at least a pair of, spaced apart, opposing, front and back needle beds and knitting fabric take-down means for capturing a knitting fabric which is in a knitting fabric passageway formed under a needle bed gap between said front and back needle beds and taking it down, said knitting fabric take-down means being formed by a plurality of take-down members which are arranged along a longitudinal direction of said needle beds and are each adapted to be actuated-to take down the knitting fabric in a knitting fabric take-down operation, wherein each of said take-down members of said knitting fabric take-down means is provided, at a body part thereof facing the knitting fabric, with a knitting fabric capturing surface, which is formed into a shape capable of capturing the knitting fabric when lowered and releasing the knitting fabric when raised; and wherein said knitting fabric capturing surface is biased in a direction in an active mode to project from said body of said take-down member to capture the knitted fabric and is so structured that in an inactive mode it can be retracted in such a position as to be kept from projecting from said body of said take-down member to capture the knitted fabric.

12. Knitting fabric take-down devices of a flat knitting machine according to claim 11, wherein said knitting fabric capturing surface is formed by a plurality of needles which are planted in a surface of a base at specified angles to point obliquely downward.

13. Knitting fabric take-down devices of a flat knitting machine according to claim 11, wherein said knitting fabric capturing surface is fitted to said body of each of said take-down members via an elastic member.

14. Knitting fabric take-down devices of a flat knitting machine according to claim 11, wherein said take-down members are connected with said take-down force adjusting means for adjusting a take-down force of said take-down means via elastic members, and an elastic member connecting portion of each of said take-down force adjusting means is changed in position to vary a resilient force of each of said elastic members, to render the knitting fabric take-down force of said knitting fabric capturing surfaces variable.

15. Knitting fabric take-down devices of a flat knitting machine according to claim 1, wherein said front and back knitting take-down members are sequentially activated.

16. Knitting fabric take-down devices of a flat knitting machine according to claim 1, wherein said front and back knitting take-down members are individually actuated.

17. Knitting fabric take-down devices of a flat knitting machine according to claim 5, wherein said needles are planted vertically relative to said base.

18. Knitting fabric take-down devices of a flat knitting machine according to claim 5, wherein said needles are planted at specified angles to said base.

19. Knitting fabric take-down devices of a flat knitting machine according to claim 5, wherein said needles are bent at intermediate positions thereof.

20. Knitting fabric take-down devices of a flat knitting machine according to claim 5, wherein said needles are bent at positions near to foremost end portions thereof.

21. Knitting fabric take-down devices for a flat knitting machine to take down a knitting fabric from the flat knitting machine, said flat knitting machine having at least a pair of front and back needle beds and a needle bed gap therebetween, said take-down devices being located in front of and back of and facing each other across a knitting fabric passageway formed under said needle bed gap, each of said knitting fabric take-down devices comprising:

front knitting fabric take-down means for capturing only a front part of the knitting fabric in the knitting fabric passageway and taking only the captured front part down;

back knitting fabric take-down means for capturing only a back part of the knitting fabric and taking only the captured back part down; and a take-down force adjusting mechanism for each of said fabric take-down means for adjusting a take-down force of each of said knitting fabric take-down means, said front and back knitting fabric take-down means each comprising a plurality of take-down members arranged along a longitudinal direction of said needle beds and each being adapted to be individually actuated to take down the captured front part and the captured rear part of the knitting fabric, each of said take-down members including a part having a knitting fabric capturing surface which is formed into a shape capable of capturing the knitting fabric when lowered and releasing the knitting fabric when raised, said knitting fabric capturing surface of said knitting fabric take-down means being biased in a first position in a direction in an active mode projecting from said take-down member and in an inactive mode said capturing surface is retracted to a second position different from said first position to the position of the projection relative to said take-down member.

22. Knitting fabric take-down devices of a flat knitting machine according to claim 21, wherein said front and back knitting take-down members are individually actuated.

* * * * *